US011839305B2

(12) United States Patent
Altemimei

(10) Patent No.: US 11,839,305 B2
(45) Date of Patent: Dec. 12, 2023

(54) SECTIONAL SEATING WITH CONNECTORS AND SUCTION HOLDING

(71) Applicant: Raad Altemimei, Orland Park, IL (US)

(72) Inventor: Raad Altemimei, Orland Park, IL (US)

( * ) Notice: Subject to any disclaimer, the term of this patent is extended or adjusted under 35 U.S.C. 154(b) by 0 days.

(21) Appl. No.: 17/698,557

(22) Filed: Mar. 18, 2022

(65) Prior Publication Data

US 2023/0062614 A1 Mar. 2, 2023

Related U.S. Application Data

(63) Continuation-in-part of application No. 17/460,846, filed on Aug. 30, 2021, now Pat. No. 11,633,046.

(51) Int. Cl.
*A47C 17/04* (2006.01)
*A47C 4/02* (2006.01)

(52) U.S. Cl.
CPC ..... *A47C 17/04* (2013.01); *A47C 4/028* (2013.01)

(58) Field of Classification Search
CPC ..... A47C 17/04; A47C 4/028; A47C 13/005
USPC ..... 297/440.14
See application file for complete search history.

(56) References Cited

U.S. PATENT DOCUMENTS

| | | | |
|---|---|---|---|
| 3,973,800 | A | 8/1976 | Kogan |
| 5,000,512 | A | 3/1991 | Laird |
| 6,241,317 | B1 | 6/2001 | Wu |
| 7,213,885 | B2 | 5/2007 | White, III et al. |
| 7,252,339 | B2 | 8/2007 | Owens |
| 7,419,220 | B2 | 9/2008 | White, III et al. |
| 7,480,947 | B2 | 1/2009 | Patella |
| 7,547,073 | B2 | 6/2009 | White, III et al. |
| 7,963,612 | B2 | 6/2011 | Nelson |
| 8,783,778 | B2 | 7/2014 | Nelson et al. |
| 9,277,826 | B2 | 3/2016 | Nelson et al. |
| 9,668,581 | B1 | 6/2017 | Hill |
| 10,070,725 | B2 | 9/2018 | Nelson et al. |
| 10,123,623 | B2 | 11/2018 | Nelson et al. |
| 10,154,733 | B2 | 12/2018 | Nelson et al. |
| 10,806,261 | B2 | 10/2020 | Nelson et al. |
| 11,406,192 | B1 | 8/2022 | Wu |

(Continued)

FOREIGN PATENT DOCUMENTS

| | | | |
|---|---|---|---|
| BR | 1020140140557 | A2 | 1/2016 |
| FR | 2699058 | A1 | 6/1994 |

(Continued)

OTHER PUBLICATIONS joybird.com, Image of Notch Modular Side found at <joybird.com/modulars/notch-modular-side/>, Applicant provided cited reference to counsel on Jul. 15, 2021, 1 page.

(Continued)

*Primary Examiner* — Mark R Wendell
(74) *Attorney, Agent, or Firm* — Greensfelder, Hemker & Gale P.C.; Richard C. Himelhoch

(57) ABSTRACT

A modular seating system is provided having one or more seat units. Each seat unit includes a plurality of legs extending downward. A suction device is connected to a lower surface of at least one of the legs to hold the seat in place on the floor. The seat units also include first connector components for connection to back units and/or arm units. The back units and arm units include second connector components configured to cooperate with the first connector components.

20 Claims, 22 Drawing Sheets

(56) References Cited

U.S. PATENT DOCUMENTS

| | | | | |
|---|---|---|---|---|
| 2006/0279124 | A1 | 12/2006 | White, III et al. | |
| 2007/0011859 | A1* | 1/2007 | Owens | A47C 7/42 29/434 |
| 2007/0085406 | A1 | 4/2007 | White, III et al. | |
| 2007/0257539 | A1 | 11/2007 | White, III et al. | |
| 2009/0315382 | A1 | 12/2009 | Nelson | |
| 2011/0298340 | A1 | 12/2011 | Nelson et al. | |
| 2016/0174715 | A1 | 6/2016 | Nelson et al. | |
| 2016/0206100 | A1 | 7/2016 | Nelson et al. | |
| 2017/0367486 | A1 | 12/2017 | Nelson et al. | |
| 2018/0000244 | A1* | 1/2018 | Nelson | A47C 13/005 |
| 2018/0078041 | A1 | 3/2018 | Nelson et al. | |
| 2018/0098631 | A1 | 4/2018 | Nelson et al. | |
| 2018/0360219 | A1* | 12/2018 | Gant | A47D 1/103 |
| 2019/0029474 | A1* | 1/2019 | Preece | A47K 3/282 |
| 2019/0142165 | A1 | 5/2019 | Nelson et al. | |
| 2020/0262696 | A1 | 8/2020 | Nelson et al. | |
| 2021/0000258 | A1 | 1/2021 | Nelson et al. | |
| 2021/0068547 | A1 | 3/2021 | Hodgson et al. | |
| 2021/0330134 | A1* | 10/2021 | Nelson | A47K 3/282 |
| 2022/0000266 | A1 | 1/2022 | Nelson et al. | |
| 2022/0104622 | A1 | 4/2022 | Chen et al. | |

FOREIGN PATENT DOCUMENTS

| | | | |
|---|---|---|---|
| JP | 57172555 | U | 10/1982 |
| NL | 1038980 | C2 | 8/2011 |

OTHER PUBLICATIONS joybird.com, Image of Notch Modular U-Sofa Sectional (7 piece) found at <joybird.com/u-sofa-sectionals/notch-modular-u-sofa-sectional/>, Applicant provided cited reference to counsel on Jul. 15, 2021, 1 page.

elephantinabox.com, Image of Dynamic Sofa found at <elephantinabox.com/products/sofa-1>, Applicant provided cited reference to counsel on Jul. 15, 2021, 1 page.

elephantinabox.com, Image of dimensions of Dynamic Sofa found at <elephantinabox.com/products/sofa-1>, Applicant provided cited reference to counsel on Jul. 15, 2021, 1 page.

allform.com, Image of Armchair Modular Design found at <allform.com/products/armchair/sand-natural>, Applicant provided cited reference to counsel on Jul. 15, 2021, 1 page.

European Patent Office, Extended European Search Report for European Application No. 22191844.4, dated Mar. 17, 2023.

* cited by examiner

CONNECTION PLATE MADE IN METAL

CONNECTOR SEAT TO SEAT

SECTIONAL SEATING WITH CONNECTORS AND SUCTION HOLDING

CROSS-REFERENCE TO RELATED APPLICATIONS

The present invention is a continuation-in-part of U.S. patent application Ser. No. 17/460,846 filed Aug. 30, 2021, the contents of which are incorporated herein by reference and made a part hereof.

FEDERALLY SPONSORED RESEARCH OR DEVELOPMENT

N/A

FIELD OF THE INVENTION

The present invention is directed to a modular seating system having a number of components that can be easily connected to each other to form a chair or couch in a variety of configurations.

DESCRIPTION OF THE PRIOR ART

A number of seating systems exist that can be arranged in different configurations. Many of these systems include various components for connecting elements of the system together. However, such systems can be complex and difficult to set up.

The present invention provides a modular seating system that can be shipped in individual components that can be easily connected to each other and assembled in a variety of configurations.

SUMMARY OF THE INVENTION

The present invention is directed to a modular seating system. The system includes a number of components that can be shipped individually and easily connected to create a variety of seating arrangements.

In accordance with one aspect of the invention, a modular seating system is provided. The system comprises a first seat having an upper surface, a first side wall extending downward from the upper surface, a second side wall extending down from the upper surface, a front wall extending downward from the upper surface and a back side wall extending downward from the upper surface. The first side wall has a set of first connector components and the back wall also has a set of first connector components. The system also comprises a first arm having a first set of second connector components for connecting the first arm to the first side wall of the first seat in a first position and a second set of second connector components for connecting the first arm to the first side wall of the first seat in a second position different than the first position. Additionally, the system comprises a first back having a first set of second connector components. The back is connected to the back wall of the first seat.

The first connector components of the system can be rails secured to the first seat. Each of the second connector components can be a slider having a generally squared off C-shaped cross-sectional shape configured to slideably fit over a respective rail. Additionally, the first connector components or the second connector components can include bearings.

The first seat can include a lower surface and a plurality of legs extending downward from the lower surface of the first seat. Similarly, both the back and the arm can include lower surfaces and legs extending downward from these surfaces.

The seat can also include a set of first connector components on a second side wall opposing the first side wall. The system can include a second arm having a first set of second connector components for connecting the arm to the seat in a first position and a second set of second connector components for connecting the arm to the seat in a second position different than the first position.

The system can include a second seat having an upper surface. The system can also include a first connector plate connecting the upper surface of the first seat to an upper surface of the second seat. The first connector plate can include a first opening and a second opening. A first screw is provided for securing the first plate to the first seat through the first opening and a second screw is provided for securing the first connector plate to the second seat through the second opening. The second seat can include a first side wall having a first set of first connector components and a back wall having a first set of first connector components. Both the first and second seats can be square, and can include a seat cushion.

Additionally, the system can include a second arm having a first set of second connector components for connecting the arm to the second seat in a first position and a second set of second connector components for connecting the second arm to the second seat in a second position different than the first position. The system can also include a second back having a first set of second connector components connected to the back wall of the second seat.

In accordance with another aspect of the invention, a modular seating system is provided comprising a first seat having an upper surface, a first side wall extending downward from the upper surface, a second side wall extending down from the upper surface, a front wall extending downward from the upper surface and a back side wall extending downward from the upper surface. The first side wall has a first set of first connector components and a second set of first connector components, and the back wall has a first set of first connector components. The system further comprises a first arm having a first set of second connector components and a first back having a first set of second connector components, the back connected to the back wall of the first seat.

Each of the first connector components can be a rail secured to the first seat. Each of the second connector components can be a slider having a generally squared off C-shaped cross-sectional shape configured to slideably fit over a respective rail.

The system can also comprise a second seat having an upper surface. A first connector plate can be used to connect the upper surface of the first seat to the upper surface of the second seat.

In accordance with another aspect of the invention a modular seating system is provided comprising a first seat having an upper surface and a lower surface, a first side wall extending downward from the upper surface, a second side wall extending down from the upper surface, a front wall extending downward from the upper surface and a back side wall extending downward from the upper surface. The first side wall has a first set of first connector components and the back wall has a first set of first connector components. The system also includes a first arm having a first set of second connector components for connecting the first arm to the first side wall of the first seat in a first position and a first back having a first set of second connector components, the back connected to the back wall of the first seat. The system also includes a second seat having an upper surface and a connector plate connecting the upper surface of the first seat to the upper surface of the second seat.

The first arm can include a second set of second connector components for connecting the first arm to the first side wall of the first seat in a second position different than the first position.

The first connector components can be a rail secured to the first seat and each of the second connector components can be a slider having a generally squared off C-shaped cross-sectional shape configured to slideably fit over a respective rail.

In accordance with yet another aspect of the invention, a modular seating system that sticks to a floor is provided. The system comprises a first seat having an upper surface, a first side wall extending downward from the upper surface, a second side wall extending down from the upper surface, a front wall extending downward from the upper surface and a back side wall extending downward from the upper surface. The back wall has a first set of first connector components. The system also includes a first back having a first set of second connector components which are connected to the back wall of the first seat. A plurality of legs extend downward from the first seat. The seat includes a first suction device connected to a lower surface of a first leg of the plurality of legs. The suction device prevents the seat from moving and can be used with other similar seats to provide a multi-unit system.

The first suction device has a first lower channel facing the floor. Additionally, the device can include a second lower channel spaced from the first lower channel, and a third lower channel spaced from the first lower channel and the second lower channel.

The suction device can be circular. Similarly, the first lower channel, the second lower channel and the third lower channel can also be circular.

The suction device has a generally planar lower surface. It can be formed from a rubber material. The suction device can be connected to the lower surface of the first leg by an adhesive material. Additionally, a second one of the plurality of legs (or all of the legs) can include a suction device.

The first side wall of the first seat can include a first set of first connector components. The system can also include a first arm having a first set of second connector components for connecting the first arm to the first side wall of the first seat in a first position and a second set of second connector components for connecting the first arm to the first side wall of the first seat in a second position different than the first position.

Each of the first connector components can be a rail secured to the first seat. Each of the second connector components can be a slider having a generally squared off C-shaped cross-sectional shape configured to slideably fit over a respective rail.

In accordance with a further aspect of the invention, a modular seating system comprises a first seat having a rectangular upper surface, a first side wall, a second side wall, a front wall and a back wall, and a first leg extending downward from the first seat, a second leg extending downward from the first seat, a third leg extending downward from the first seat and a fourth leg extending downward from the first seat. A first rail connector component is positioned on the first side wall of the first seat, and a second rail connector component is positioned on the back wall of the first seat. A first suction device is connected to the first leg, a second suction device is connected to the second leg, a third suction device is connected to the third leg and a fourth suction device is connected to the fourth leg.

Each of the first, second, third and fourth suction devices can include a first downward facing channel, a second downwardly facing channel spaced from the first downwardly facing channel and a third downwardly facing channel spaced from the second downwardly facing channel and the first downwardly facing channel. Moreover, each of the first, second, third and fourth suction devices can be circular, and each of the first downwardly facing channel, the second downwardly facing channel and the third downwardly facing channel can be circular.

The system can further comprise a first arm having a slider connector component slideably engaging the first rail connector component of the first seat. The first arm can also have a first leg extending downward from the first arm and a second leg extending downward from the first arm. Each leg can have a suction device connected thereto.

The system can also further comprise a first back having a slider connector component slideably engaging the second rail component of the first seat. The back can also have a first leg extending downward from the first back and a second leg extending downward from the first back. Again, each leg can include a suction device.

In accordance with yet a further aspect of the invention, a modular seating system comprises a plurality of seats where each seat has a first rail connector component and a plurality of legs where at least one of the plurality of legs includes a suction device. The system further comprises an arm unit having a slider connector component coupled to the first rail component of one of the plurality of seats, and a back unit having a slider connector component coupled to a first rail component of a second one of the plurality of seats.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1:
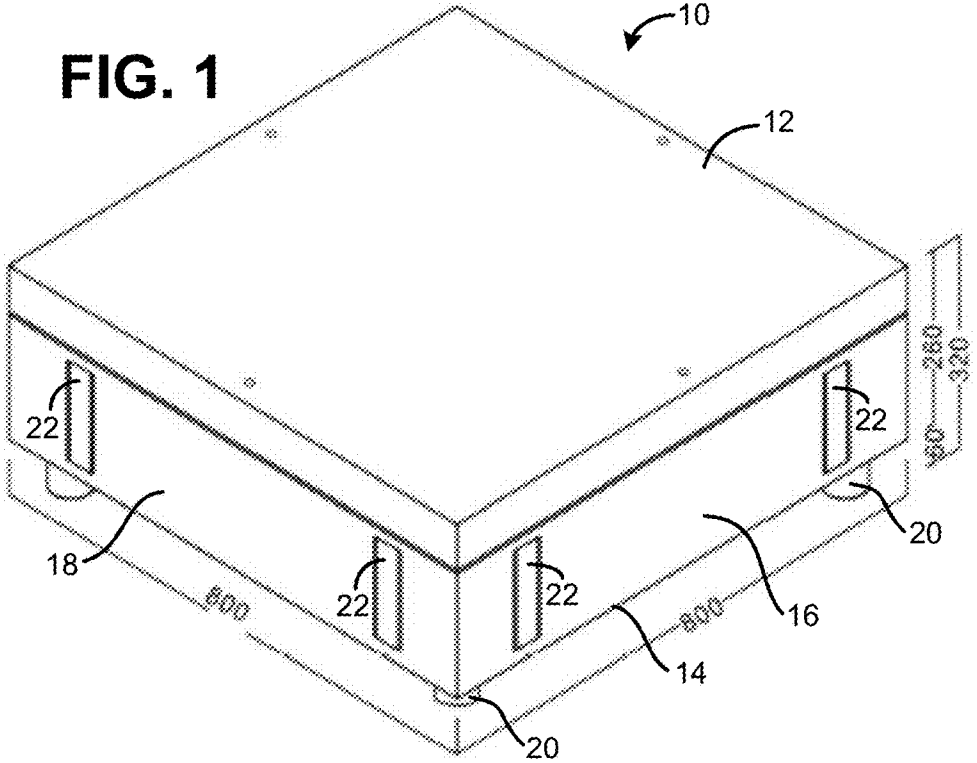
FIG. 1 is a perspective view of a seat in accordance with an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a modular seating system that can be easily set up in a variety of configurations. The system can be set up as a chair, a loveseat, or a sectional couch that can be, for example, L-shaped, U-shaped or simply be an enlarged loveseat. A variety of other configurations can also be implemented. The basic components of the system can be shipped individually and then put together on site by the purchaser in the desired configuration. Additionally, the basic components include connectable structures that make assembly easy for anyone.

Figure 2:
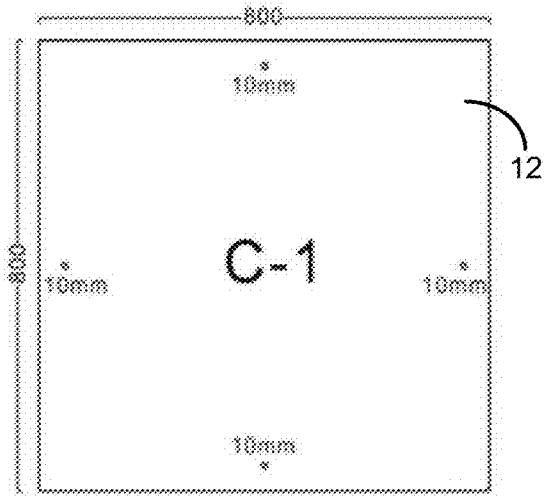
FIG. 2 is a top plan view of the seat of FIG. 1.
Figure 3:
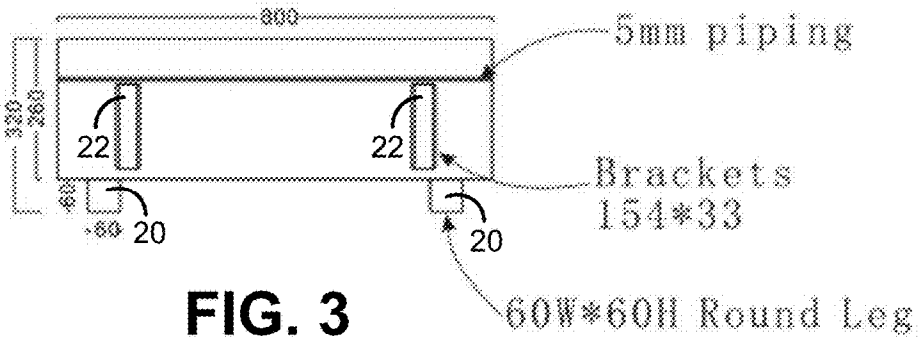
FIG. 3 is a first side plan view of the seat of FIG. 1.
Figure 5:
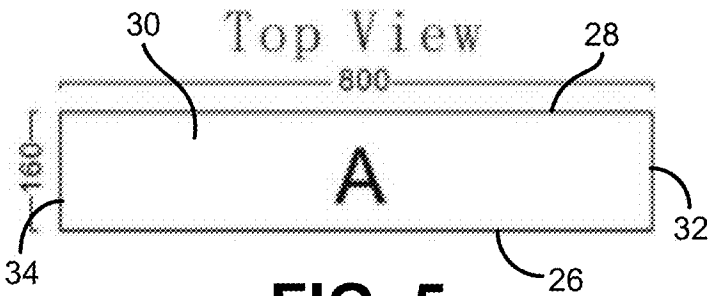
FIG. 5 is a top plan view of the back unit of FIG. 4.
Figure 4:
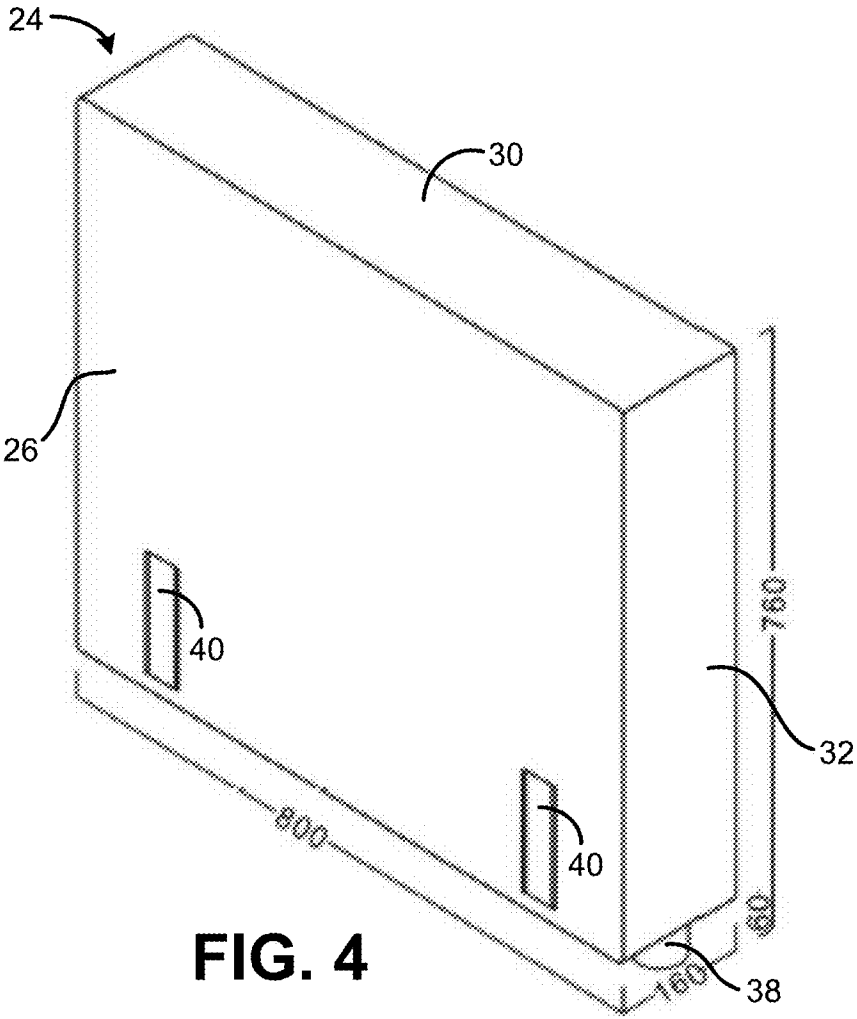
FIG. 4 is a perspective view of a back unit in accordance with an embodiment of the present invention.
Figure 7:
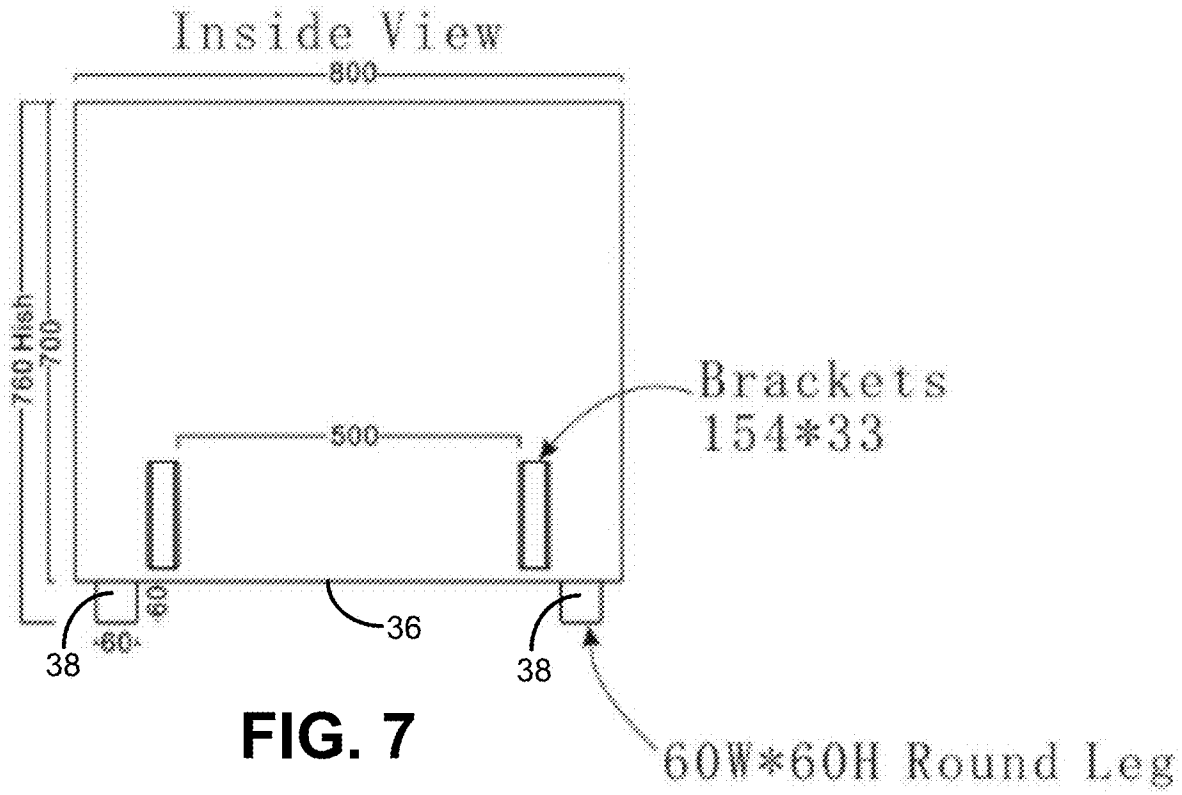
FIG. 7 is an interior side plan view of the back unit of FIG. 4.
Figure 6:
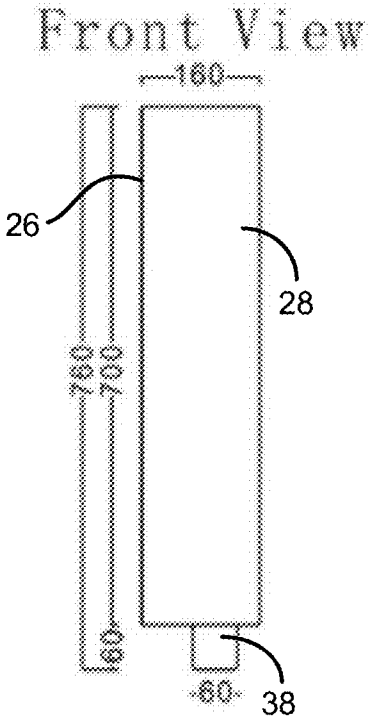
FIG. 6 is a side plan view of the back unit of FIG. 4.
Figure 8:
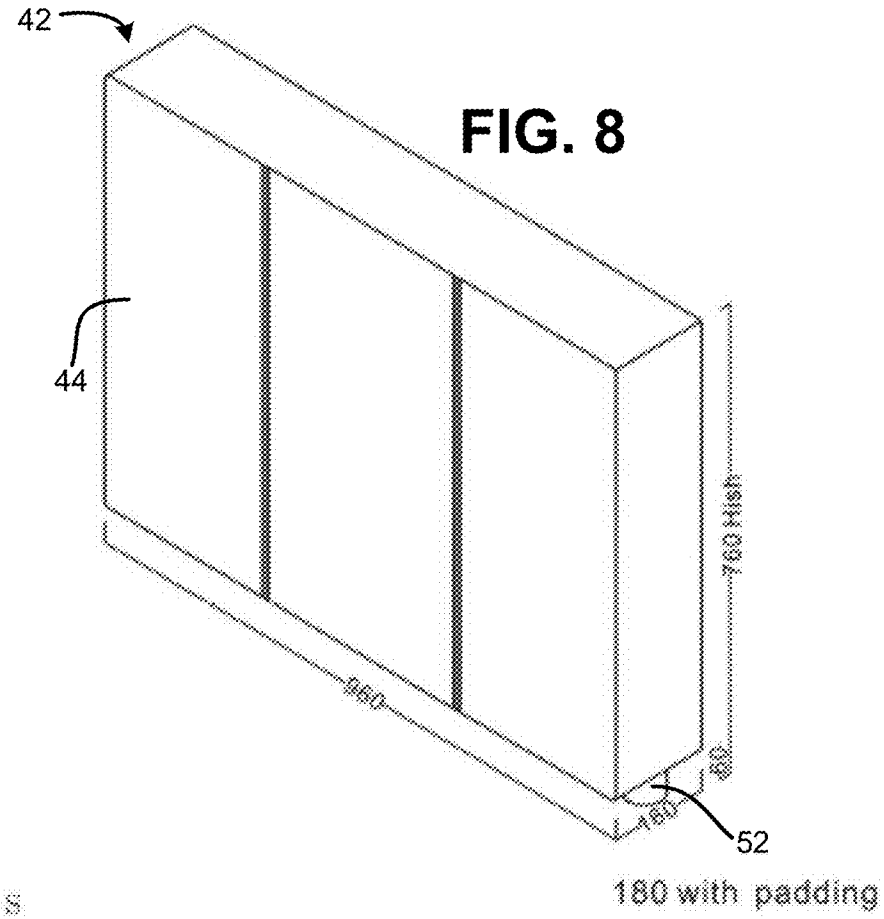
FIG. 8 is a perspective view of an arm unit in accordance with an embodiment of the present invention.
Figure 9:
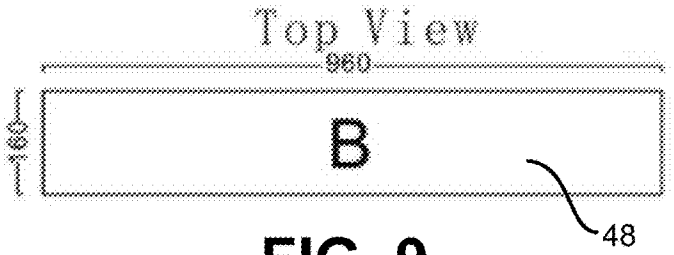
FIG. 9 is a top plan view of the arm unit of FIG. 8.
Figure 10:
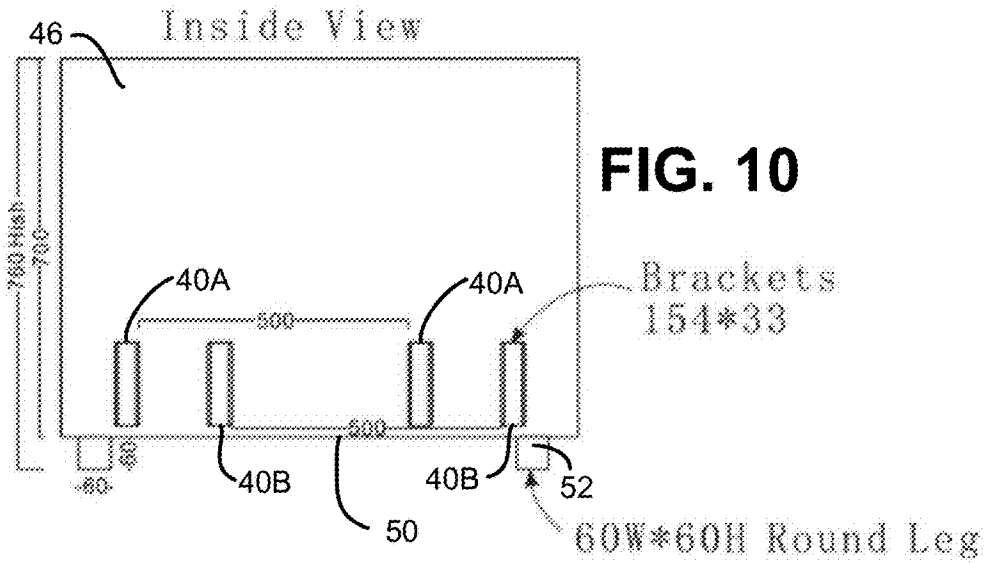
FIG. 10 is an interior side plan view of the arm unit of FIG. 8.
Figure 12:
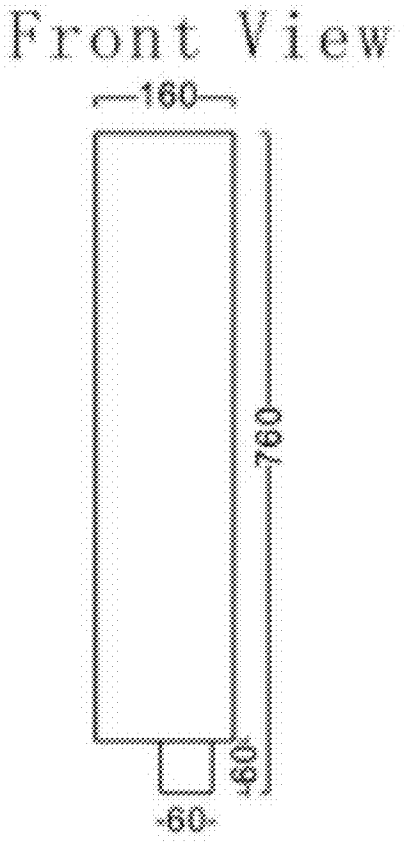
FIG. 12 is a front view of the arm unit of FIG. 8.
Figure 11:
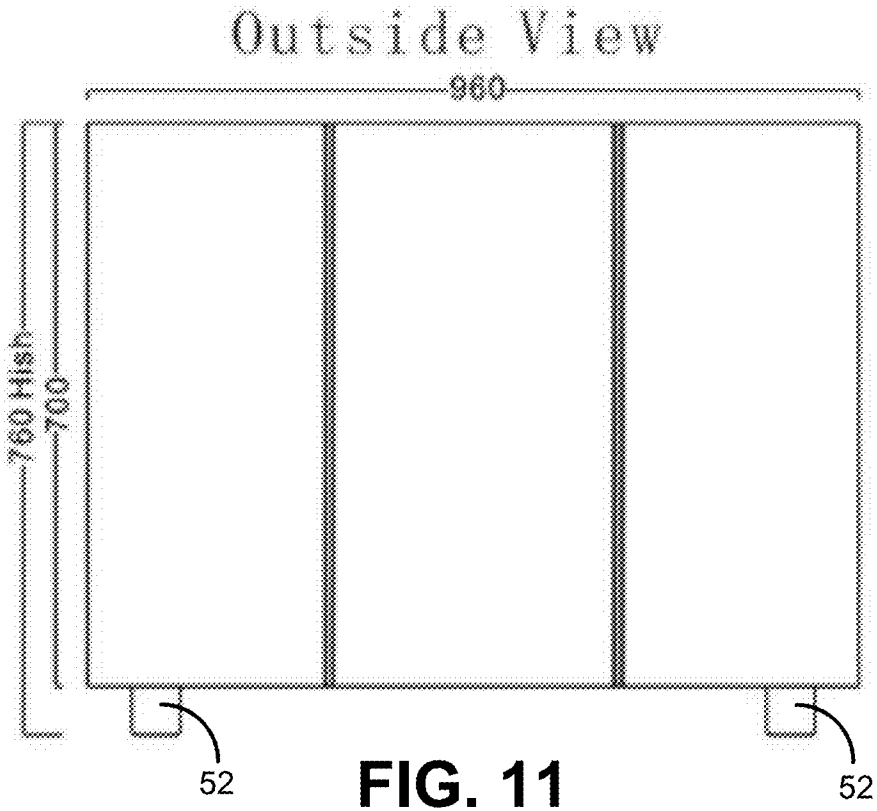
FIG. 11 is an exterior side plan view of the arm unit of FIG. 8.
Figure 15:
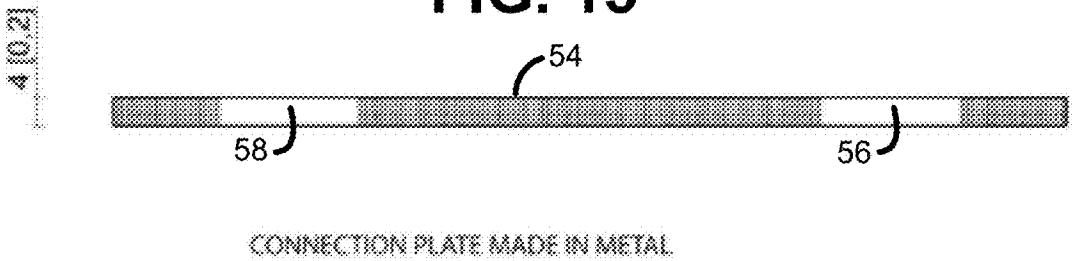
FIG. 15 is a cross-sectional side view of the connection plate of FIG. 13.
Figure 13:
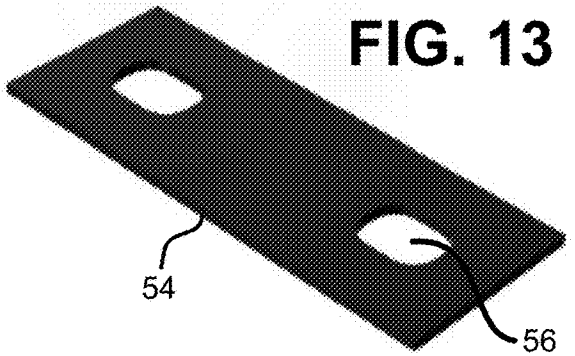
FIG. 13 is a perspective view of a connection plate in accordance with the present invention.
Figure 14:
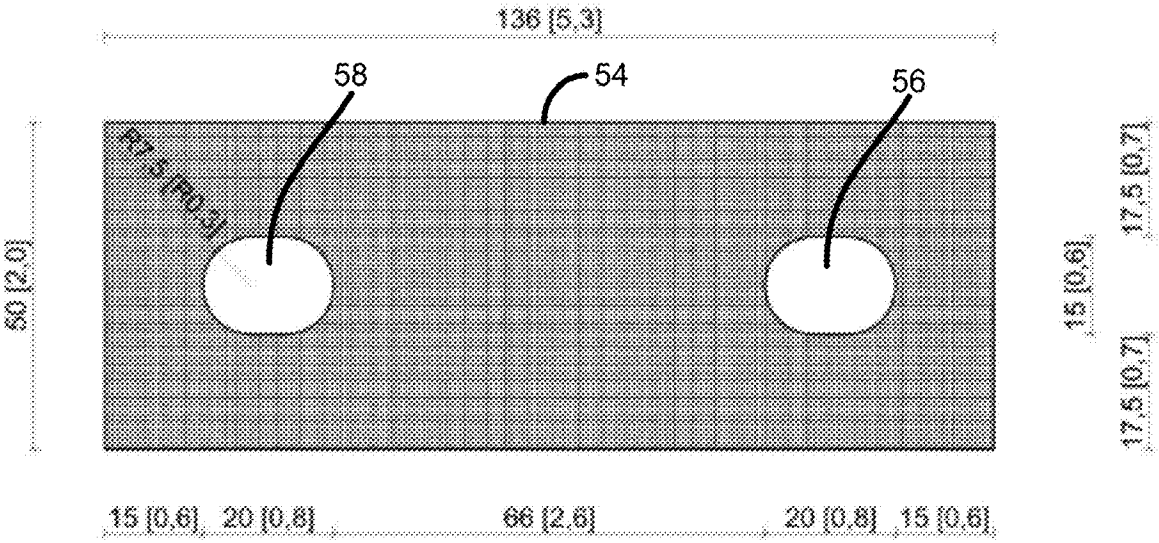
FIG. 14 is a top plan view of the connection plate of FIG. 13.

A seat unit 10 (or simply "seat") for use in the system is shown in FIGS. 1-3. The seat 10 includes a generally square upper surface 12 and four side walls extending downward from the four sides of the upper surface 12 to a bottom surface 14. A first side wall 16 and a second side wall 18 are shown in FIG. 1. A plurality of legs 20 extend downward from the bottom surface 14. The legs 20 are generally positioned proximate the corners of the bottom surface 14. The legs 20 are generally cylindrical, however, they can be in a variety of different shapes.

The seat unit 10 is shown in FIGS. 1-3 without a seat cushion. A seat cushion can be seen in FIGS. 20 and 22-23.

The seat 10 includes a set of first connector components 22 on the first side wall 16 and another set of connector components 22 on the second side wall 16. The seat 10 can also include a set of first connector components 22 on a third side wall (opposing the first side wall 16). Each of the connector components 22 in a set are spaced from each other. As discussed in more detail herein, the first connector components 22 are brackets that cooperate with second connector components on an arm unit or back unit.

FIGS. 4-7 show a back unit (or simply "back") 24 that can be used with the seat unit 10. The back 10 is generally rectangular having an interior side 26 (i.e., a side that would form a back surface of any chair or couch in a seating system, albeit supporting a back cushion), an exterior side 28, a top wall 30, a first side wall 32 and a second side wall 34. The back 24 also includes a bottom wall 36 and legs 38 extending downward from the bottom wall 36.

The interior side of the back also includes a set of second connector components 40. Each of the set of second connector components 40 are spaced out from each other to match the set of first connector components on the second side wall 18 of the seat 10.

The first connector components 22 and the second connector components 40 are designed to fit together to securely connect the back 24 to the seat 10. In this regard, one of the connector components is in the form of a rail having a generally rectangular cross-sectional shape, and the other component is a slider or bracket having a squared-off, generally C-shaped cross-sectional shape sized to slidingly fit over the rectangular cross-section of the rail. The first and second connector components 22, 40 are shown (without a seat or back unit) in FIGS. 26A-26C. Each connector component 22, 40 includes openings 74 to enable the connector to be secured to the seat or back (or arm as described below) with screws, nails or bolts, etc.

Figure 26C:
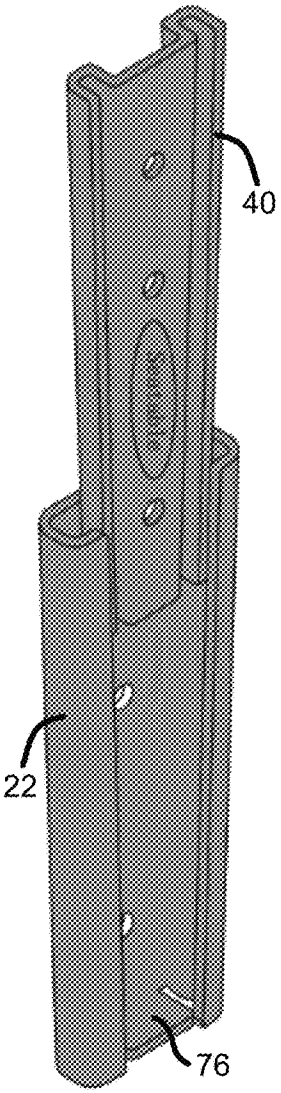
FIGS. 26A-26C show views of the first connector component and the second connector component without seats, backs or arms.
Figure 26B:
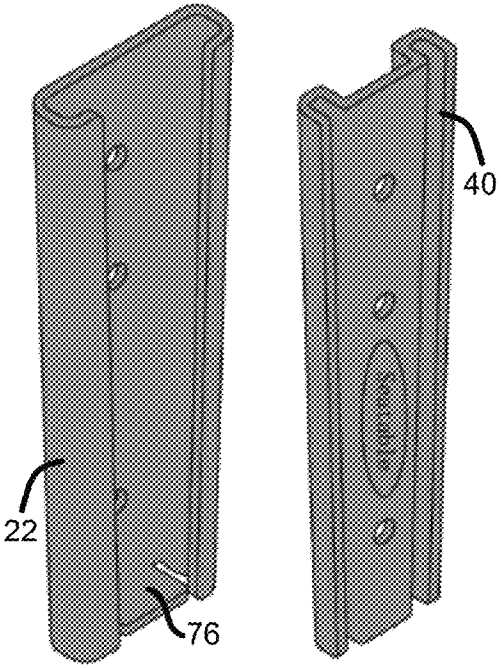
Figure 26A:
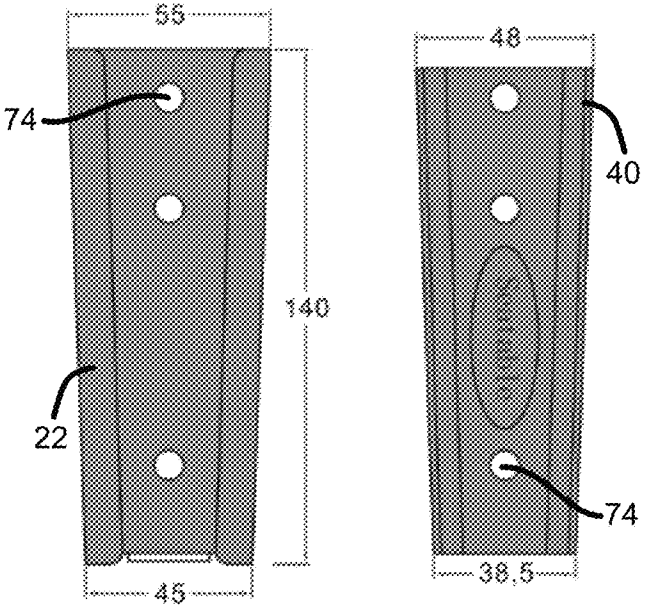

As shown in FIG. 26C, the second connector component 40 is sized and designed to fit in an opening (having the generally C-shaped cross-sectional shape) at the top of the first connector component 22 and slide downward. The first connector component 22 includes a bottom wall 76 to stop the second connector component 40. As illustrated in the front plan view of FIG. 26A, the top of the first connector component 22 is slightly wider than the bottom of the component, which causes the sides of the component to angle slightly toward each other (from top to bottom). Similarly, the second connector component 40 also has a slightly wider top (albeit smaller than that of the first connector component) than the bottom of the second connector component 40. Again, this causes the sides of the second connector component to angle slightly toward each other (from top to bottom). The angled sides of the components 22, 40 provide for a snug, secure fit when connected to each other while enabling the second component 40 to be easily removed when disassembling the system 10.

In some instances, one of the first or second connector components can be fitted with bearings to further facilitate the slide-ability of the bracket with respect to the rail. In this regard, the first and second connector components of the present system can be similar to the components of a drawer slide bracket or similar structures. In the present system, the first connector components 22 on the seat 10 are preferably the rail structures and the second connector components 40 on the back 24 are the C-shaped brackets that fit over the rails. However, these can be reversed if desired.

FIGS. 8-12 show an arm unit (or just "arm") 42 for use in the system. The arm 42 includes an exterior side 44, an interior side 46 and a top wall 48. The arm 42 also includes a bottom wall 50 and legs 52 extending downward from the bottom wall 50.

Similar to the back unit 24, the arm 42 also includes second connector components for connecting to the first connector components 22 on the seat 10. However, the arm 42 has two sets of staggered second connector components 40A and 40B. The first set of second connector components 40A allows for connecting the arm 42 to the seat 10 in a first position, and the second set of second connector components 40B allows for connecting the arm 42 to the seat 10 in a second position different than the first position. Additional sets of second connectors can be added as desired for additional positions (or to accommodate different sized or shaped seats). The back unit 24 can be similarly modified to include additional second connector components, and/or the seat 10 can be similarly modified to include additional first connector components.

With the first and second connector components, a seat 10 can be connected to a back unit 24 and one or more arm units 42 to form a chair. However, to form a more complex seating system, two or more seat units 10 can be connected together. The multiple seats 10, along with additional back units 24 and arm units 42 can form a sectional sofa or couch having a variety of configurations.

Figure 17:
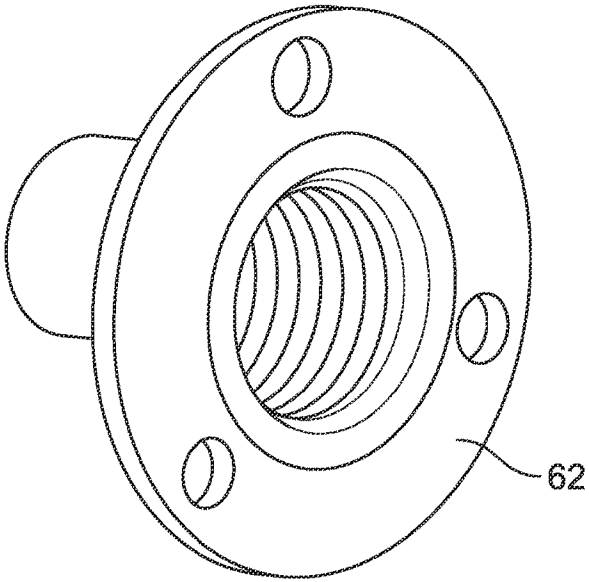
FIG. 17 is a perspective view of a nut for use with the connection plate of FIG. 13.
Figure 16:
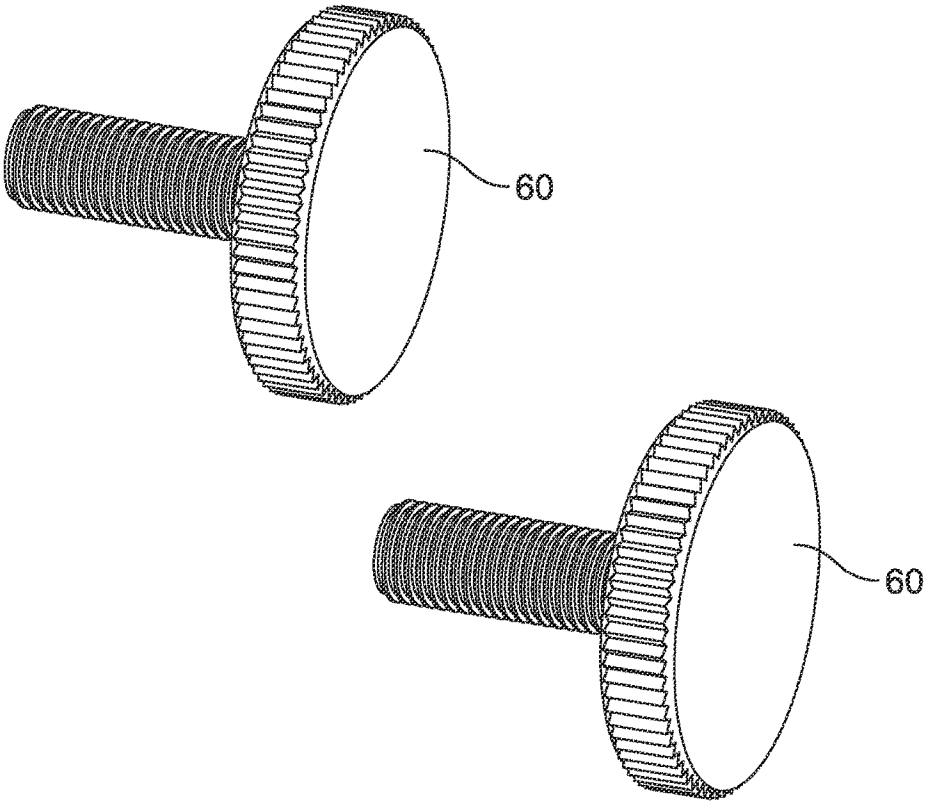
FIG. 16 is a perspective view of screws for use with the connection plate of FIG. 13.
Figure 18A:
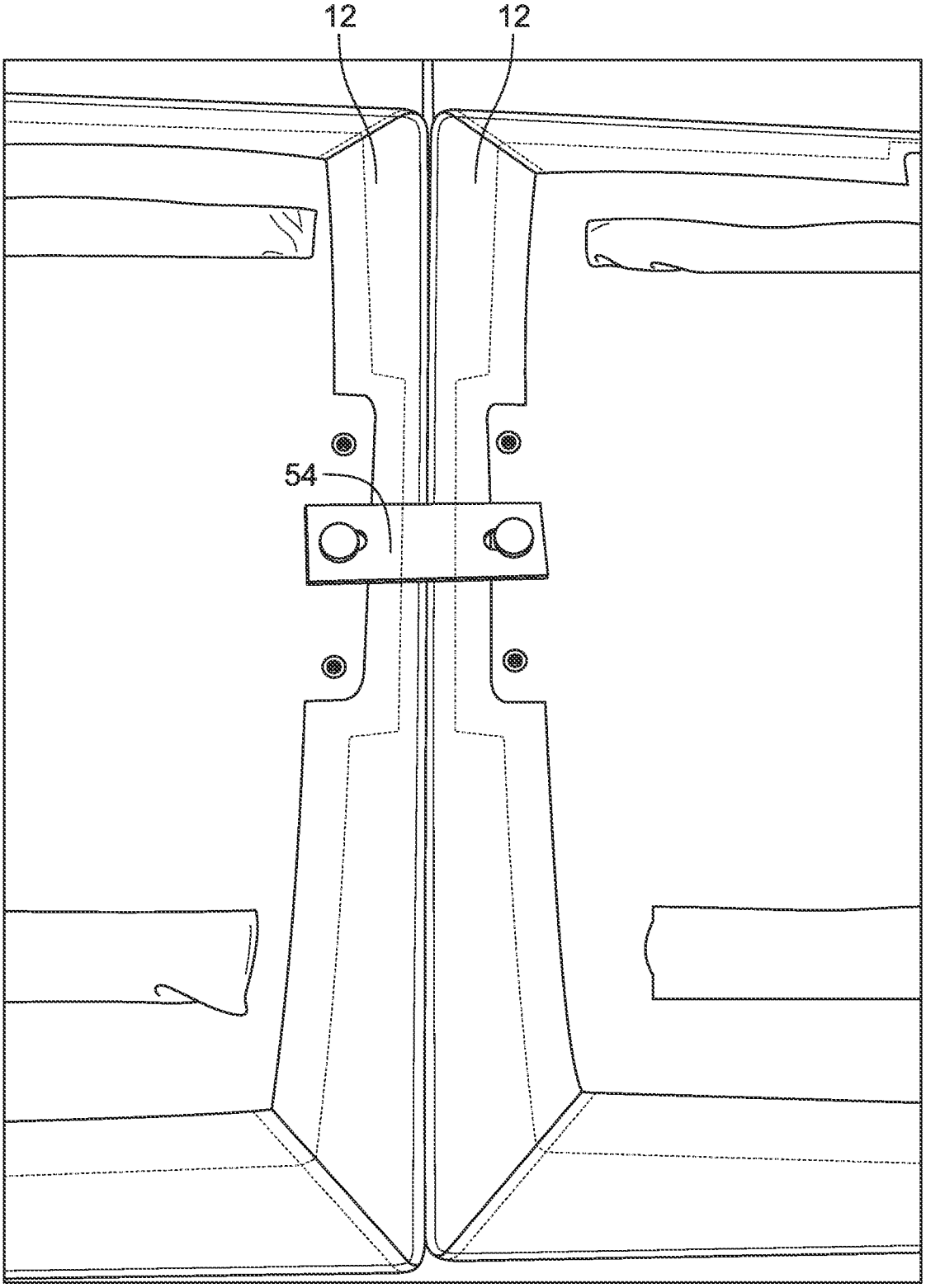
FIGS. 18A-18C are views of a connection plate connecting a first seat unit to a second seat unit.
Figure 18B:
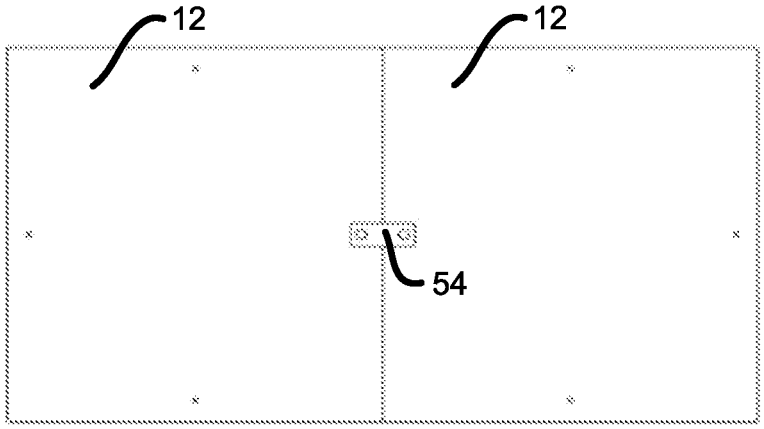
Figure 18C:
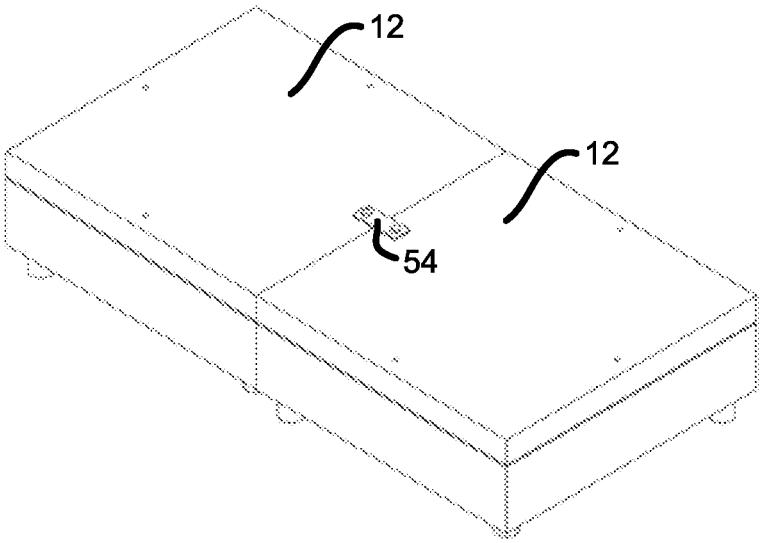

The present system includes a connection plate 54, as illustrated in FIGS. 13-19, for connecting a first seat 10 to a second seat 10. The connection plate 54 is generally rectangular and includes a first aperture 56 proximate a first end and a second aperture 58 proximate a second end. Screws 60 can be used to secure the connection plate 54 to the top surface 12 of the first seat 10 and the top surface 12 the second seat 10 as shown in FIG. 18 (alternatively, the connection plate could be secured to the bottom surfaces 14 of each seat). In some instances, the seat 10 can include a nut 62 (as shown in FIG. 17) or similar structure for receiving the screw 60. Additionally, other similar structure can be used to secure the connector plate 54 to the seats 10.

Figure 19A:
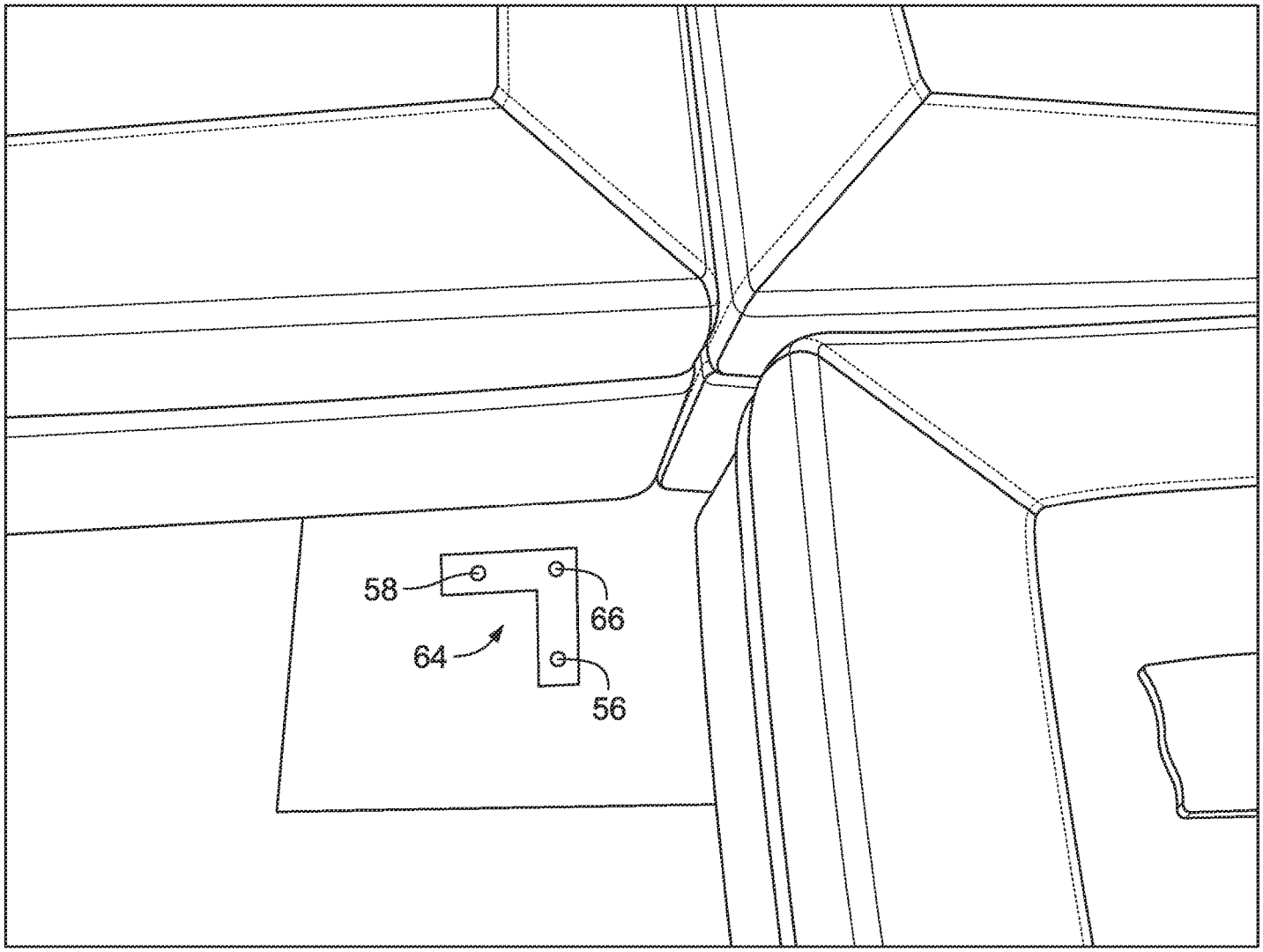
FIGS. 19A-19D are views of an L-shaped connection plate for use in securing three seat units together.
Figure 19C:
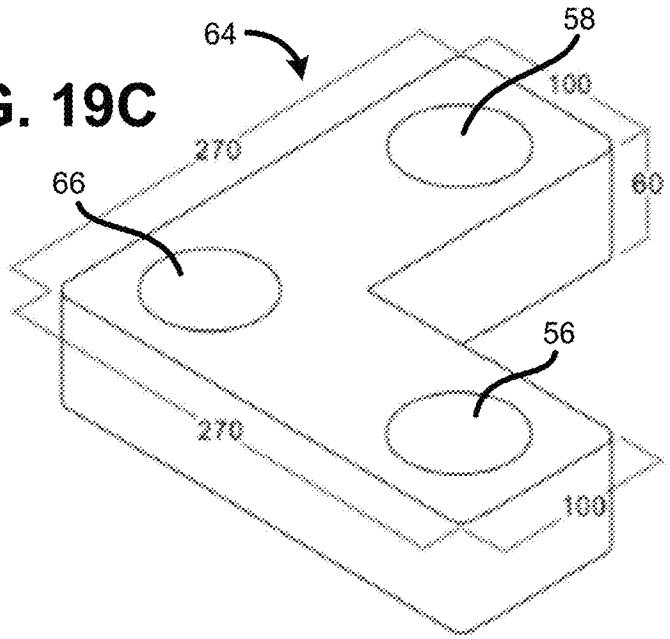
Figure 19B:
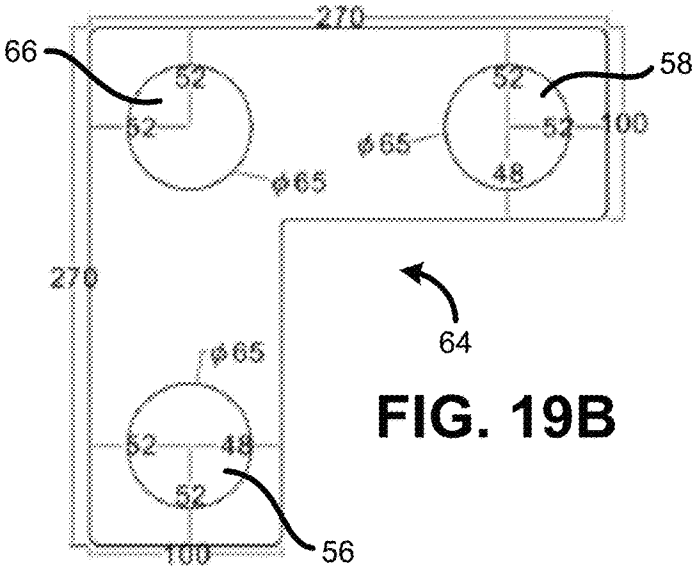
Figure 19D:
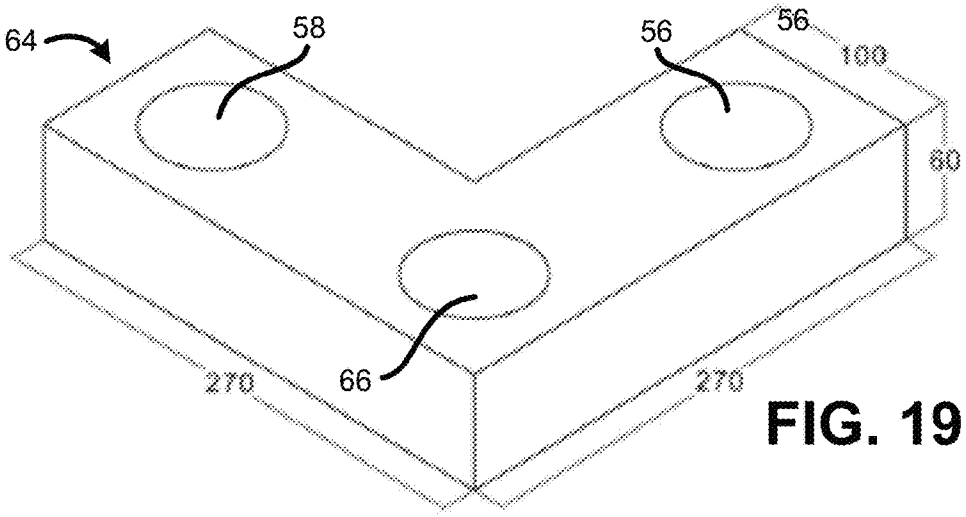

As shown in FIGS. 19A-D, an L-shaped connection plate 64 can be used to connect three seats 10 together in similar configuration (e.g., FIG. 19A). The L-shaped connection plate 64 includes a third aperture 66 proximate the bend in the plate between the first and second apertures 58 and 56. Each aperture in the L-shaped connection plate 64 is used to secure the connection plate 64 to one of three seat components 10.

Figure 20A:
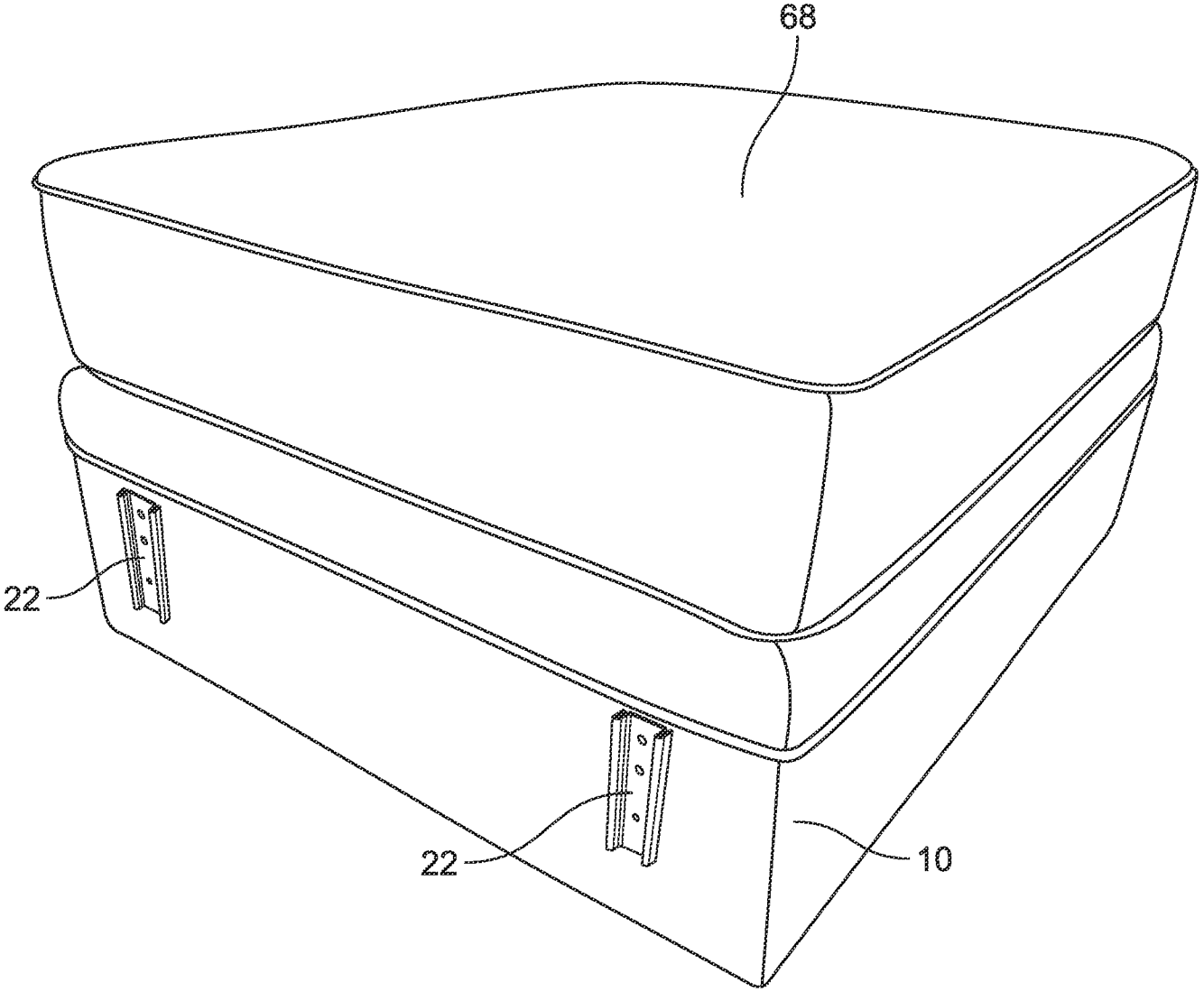
FIGS. 20A and 20B are perspective views of a seat unit with a seat cushion with and without cutouts for the fabric.
Figure 20B:
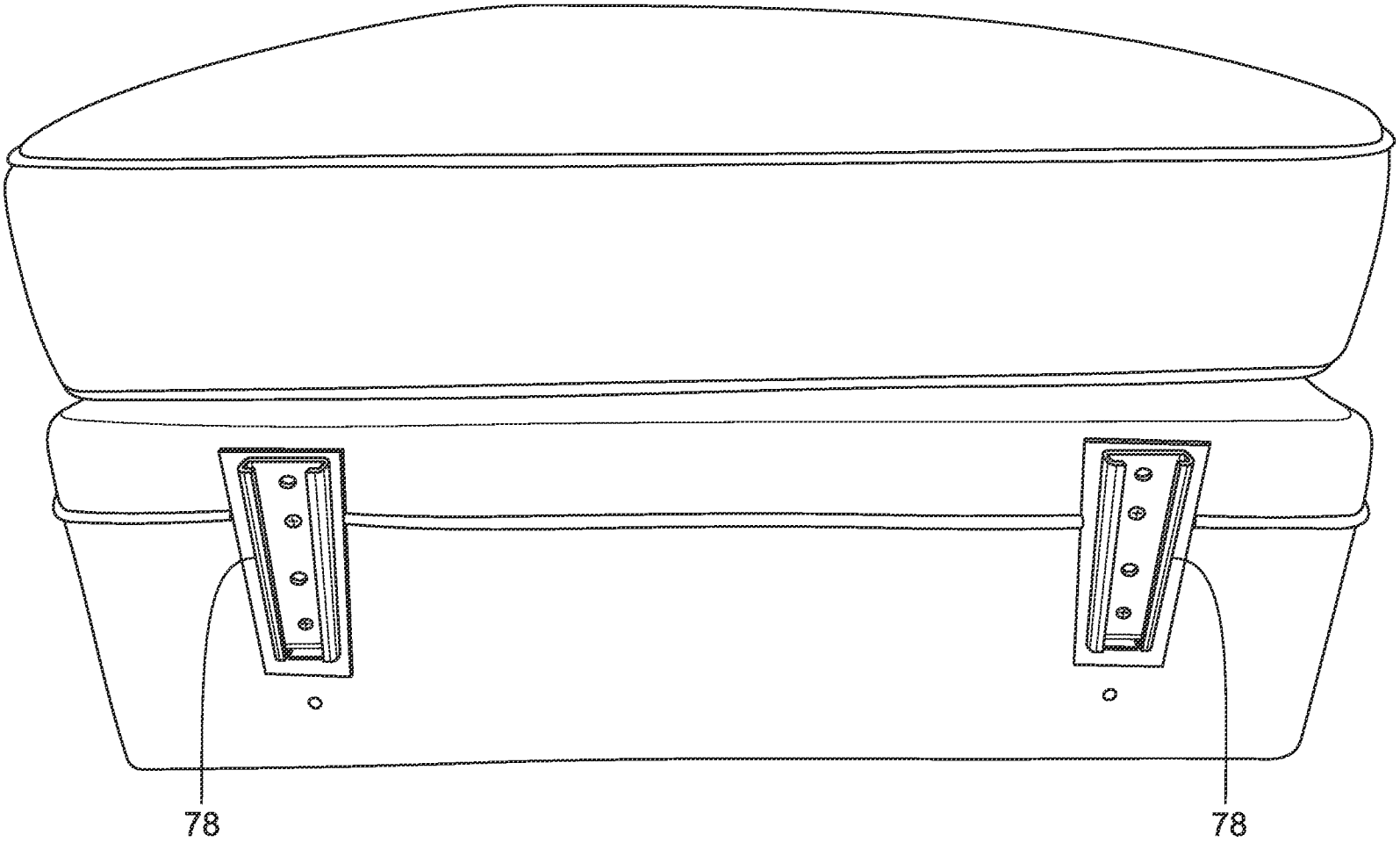

Once two seats 12 are connected, each seat can be provided a cushion 68 which will cover and hide the connection plate 54. A seat 10 with a seat cushion 68 is shown in FIGS. 20A and 20B. FIG. 20B shows the fabric around the seat 12 having cutouts 78. The cutouts 78 facilitate removal of the fabric (e.g., for replacement or cleaning) without requiring first removing the first connector components 22. The back and arm can include similar cutouts.

Figure 21:
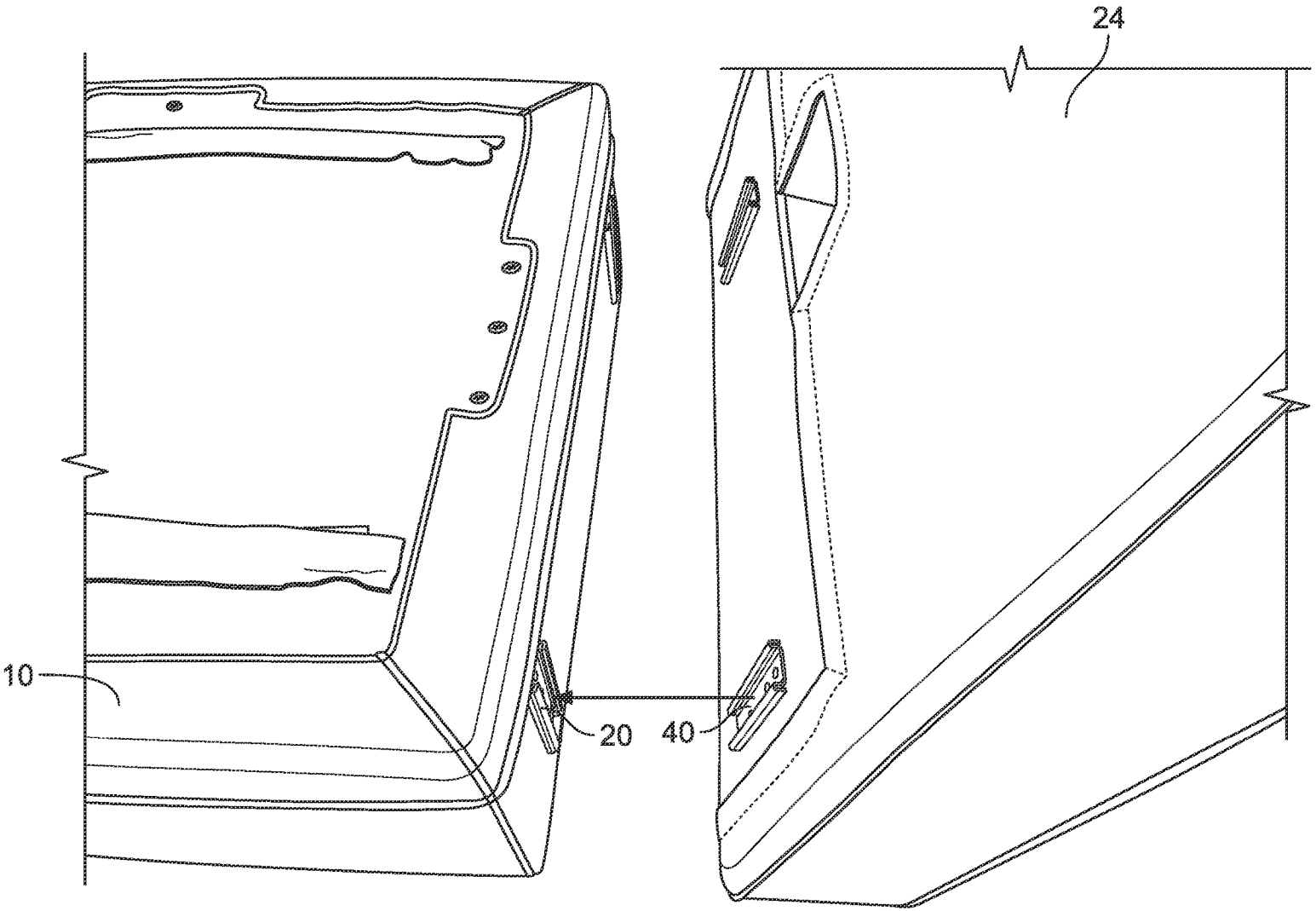
FIG. 21 is a perspective view of a seat unit and a back unit before connection via the first connector components on the seat unit and the second connector components on the back unit.

FIG. 21 shows a back unit 24 and a seat unit 10 slightly separated from the back unit 24. The first connector components 22 on the seat unit 10 are aligned with the second connector units 40 on the back unit 24. Simply lifting the back unit 24 so that the bottom of the second connector components 40 slide over the top of the first connector components 22 secures the back unit 24 to the seat unit 10. A similar procedure is used to secure the arm unit 42 to the seat unit 10.

Figure 22:
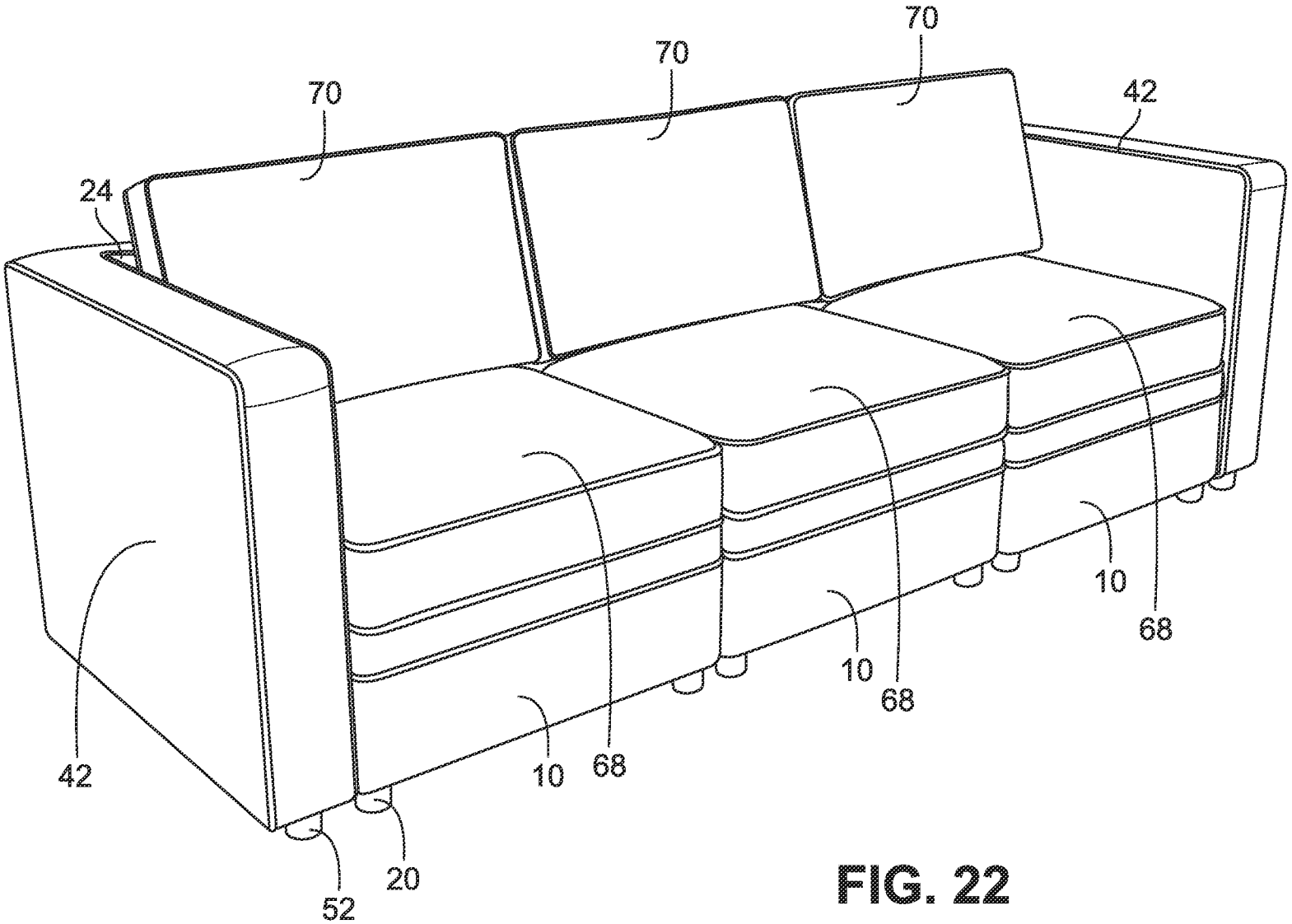
FIG. 22 is a perspective view of a modular seating system in accordance with one aspect of the invention.

FIG. 22 shows one combination of the components of the seating system configured as a couch. In addition, the seat cushion 68, the couch also includes back cushions 70. The cushions can be loose, or alternatively, secured to the seat or back units by hook and loop material, snaps or other similar means.

Figure 23:
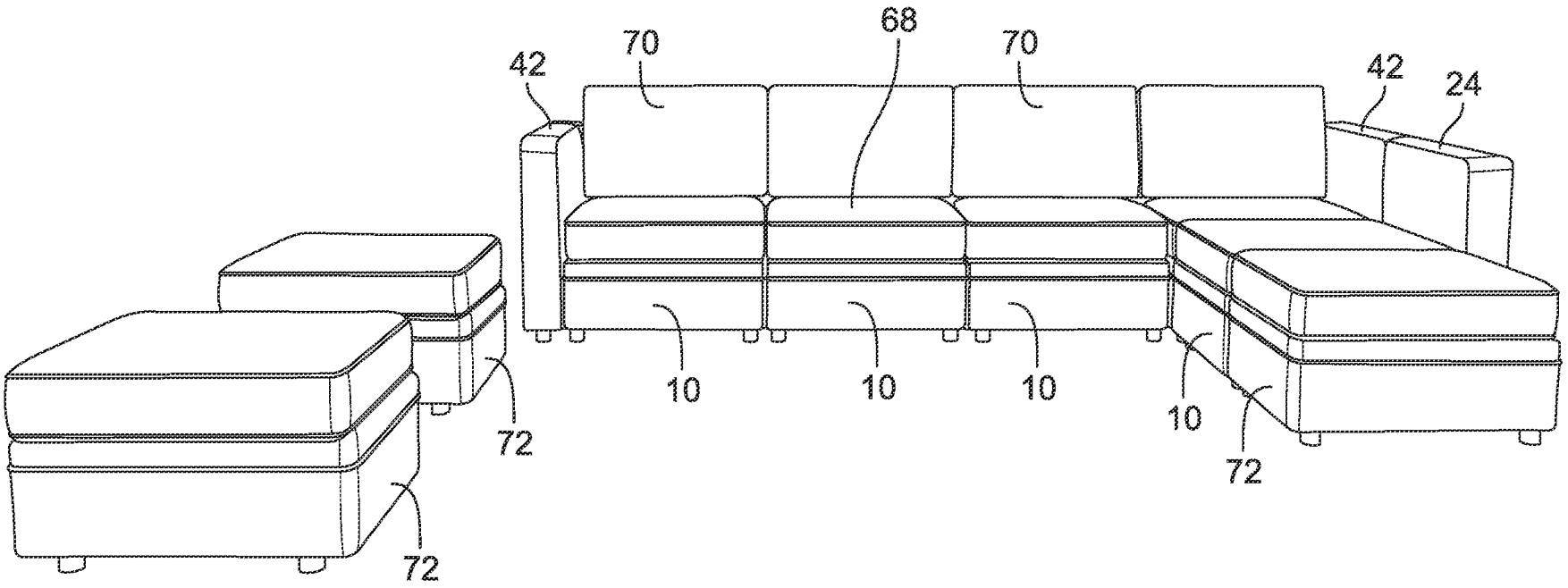
FIG. 23 is a perspective view of a modular seating system in accordance with another aspect of the invention.
Figure 24:
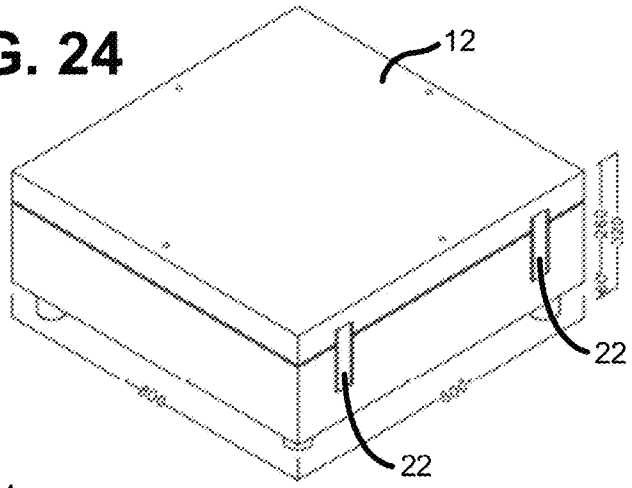
FIG. 24 is a perspective view of another seat for use in the present invention having first connector components on only one side of the seat for connection to a back.
Figure 25B:
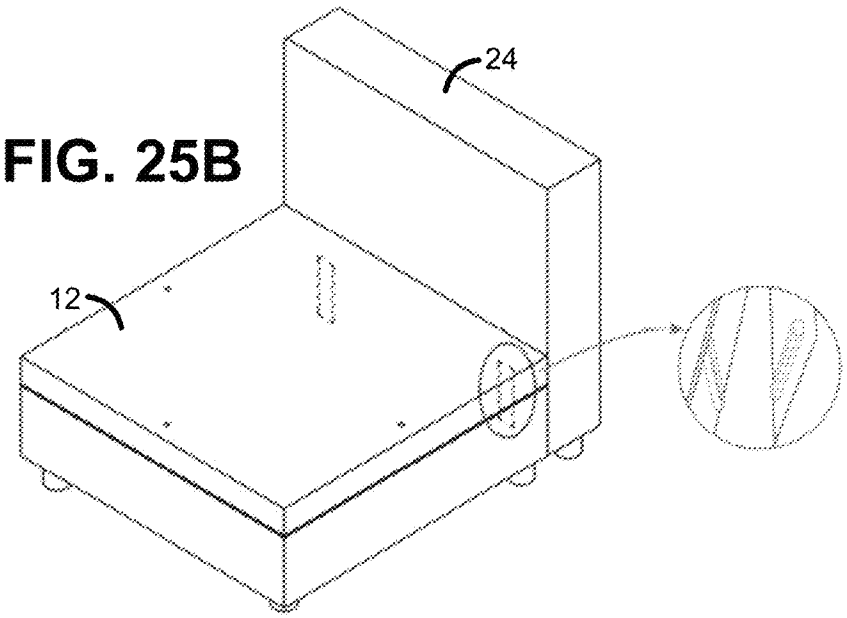
FIGS. 25A-25B show a back being connected to the seat of FIG. 24.
Figure 25A:
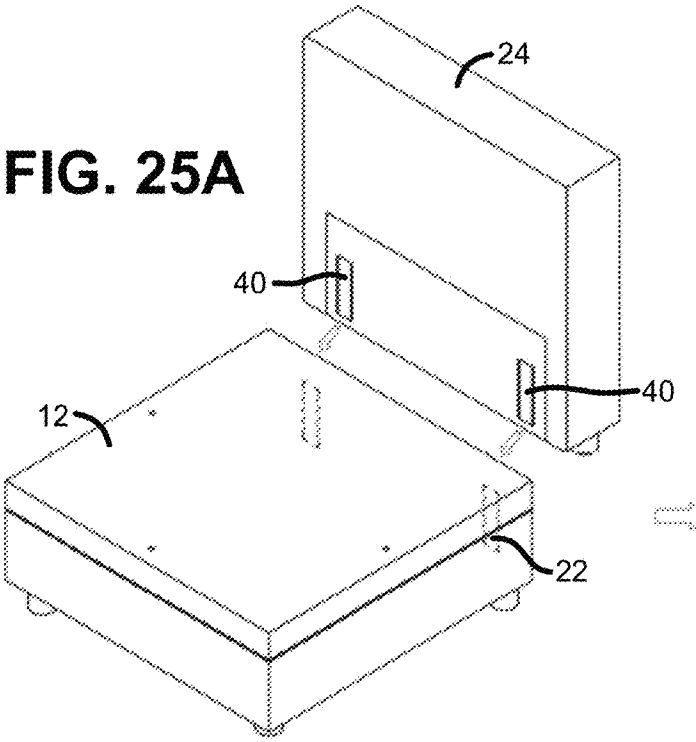

FIG. 23 shows an L-shaped configuration of the seating system. Additionally, seat units 72 without connector components can be utilized in the system. Instead of legs, these units can be provided with rollers to easily move them around.

In accordance with another embodiment of the invention, a modular seating system having a number of seats can be implemented without connection plates 54 connecting the seat units 10 to each other. Instead of requiring the connection plates 54, each seat unit 10 includes a suction device 100 connected to the bottom surface of one or more of the legs 20 of the seat 10. The suction device 100 adheres to the floor and prevents the seat 10 from moving with respect to other seats 10 in the system. The other connector components described above—e.g., the first connector components 22 and the second connector components 40—can be used with the system to connect the backs 24 and arms 24 to the seat 10. Moreover, the suction device 100 can be used with one or more of the legs 38, 52 extending from the backs 24 and arms 42 that are connected to the seats 10.

Figure 27:
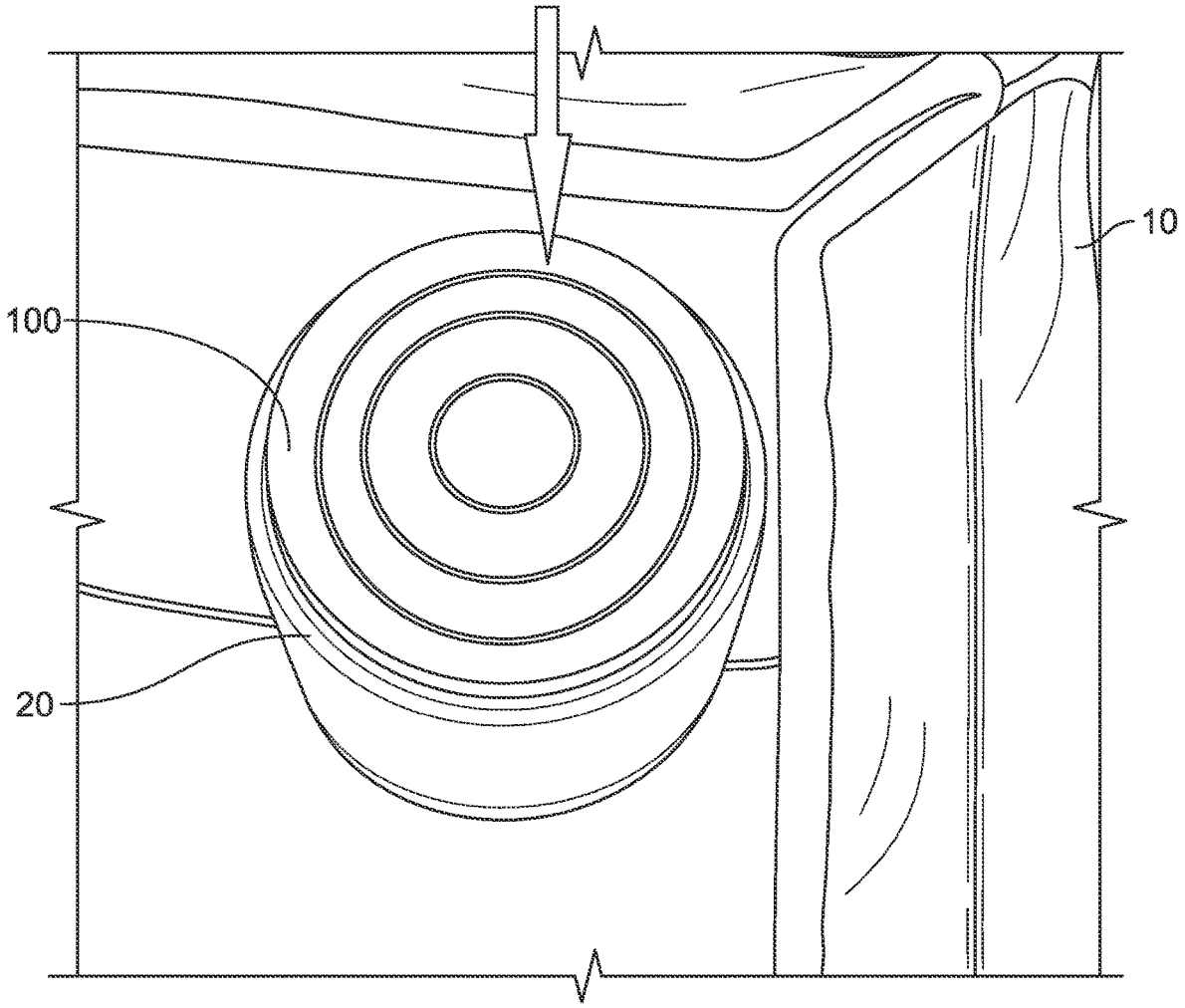
FIG. 27 is a bottom perspective view of a suction device in accordance with an aspect of the present invention connected to the bottom surface of a leg of a seat.
Figure 28:
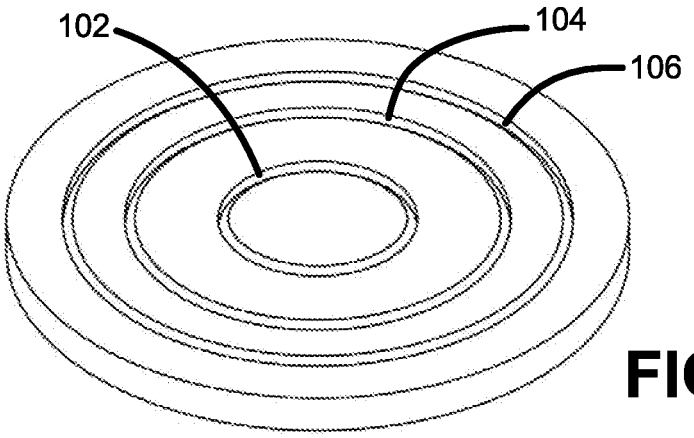
FIG. 28 is a perspective of the suction device of FIG. 27.
Figure 29:
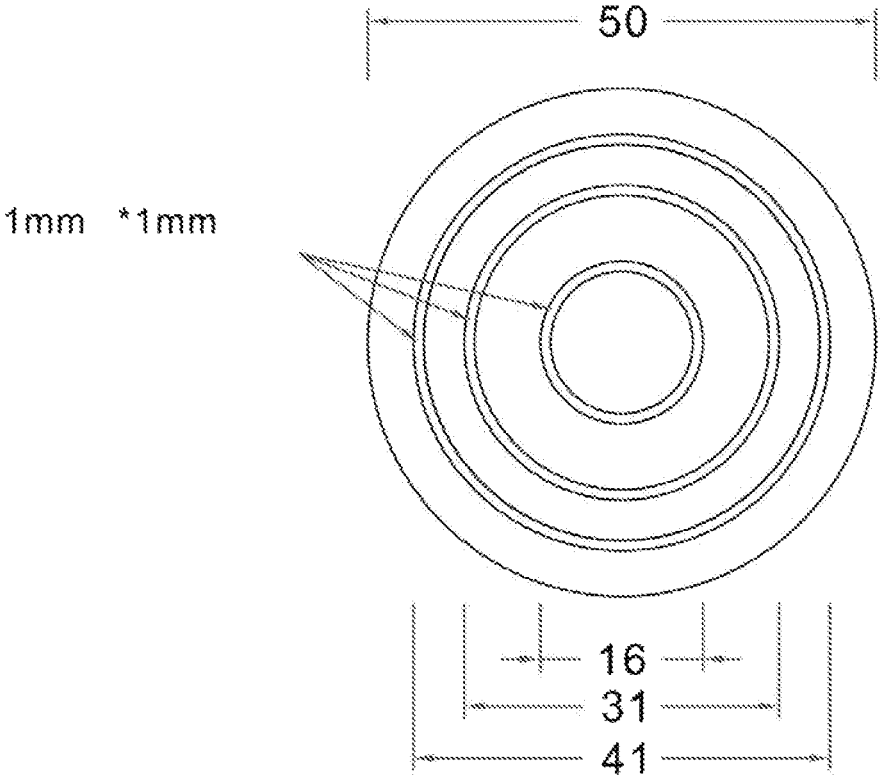
FIG. 29 is a bottom view of the suction device of FIG. 27.

As shown in FIGS. 27-29, the suction device 100 is a circular disk having a plurality of channels 102, 104, 106 in concentric circles about the lower surface of the disk. The disk 100 can be formed from rubber or other similar material, and can be connected to the lower surface of the leg 20 with an adhesive on an upper surface of the disk. The disk is approximately 3-5 millimeters thick. The channels 102, 104, 106 provide a suction effect when placed on the floor, that, along with a coefficient of friction of the rubber material, keep the leg (and therefore the seat, arm or back) in place.

Figure 31:
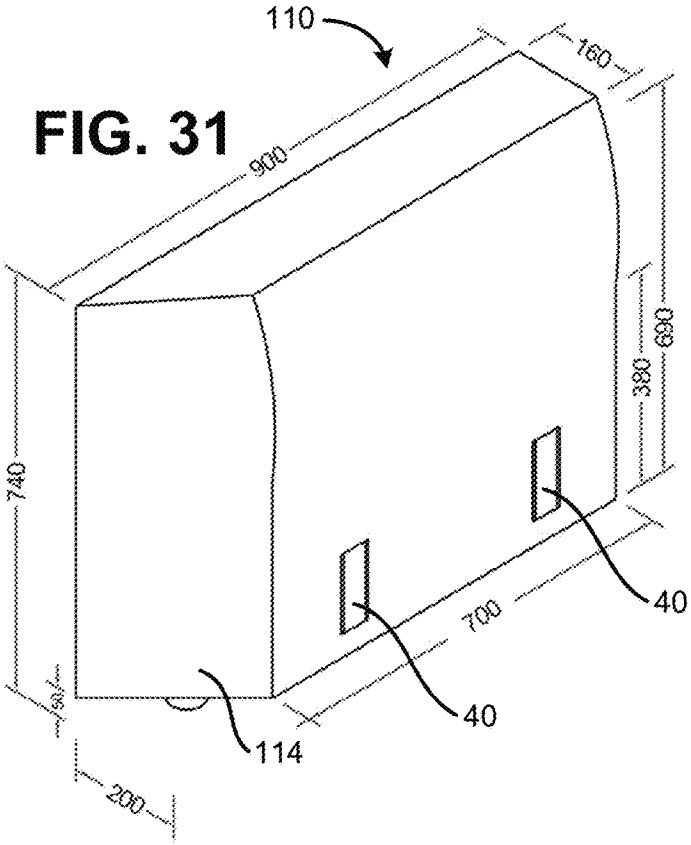
FIG. 31 is a perspective view of a second corner back unit.
Figure 30:
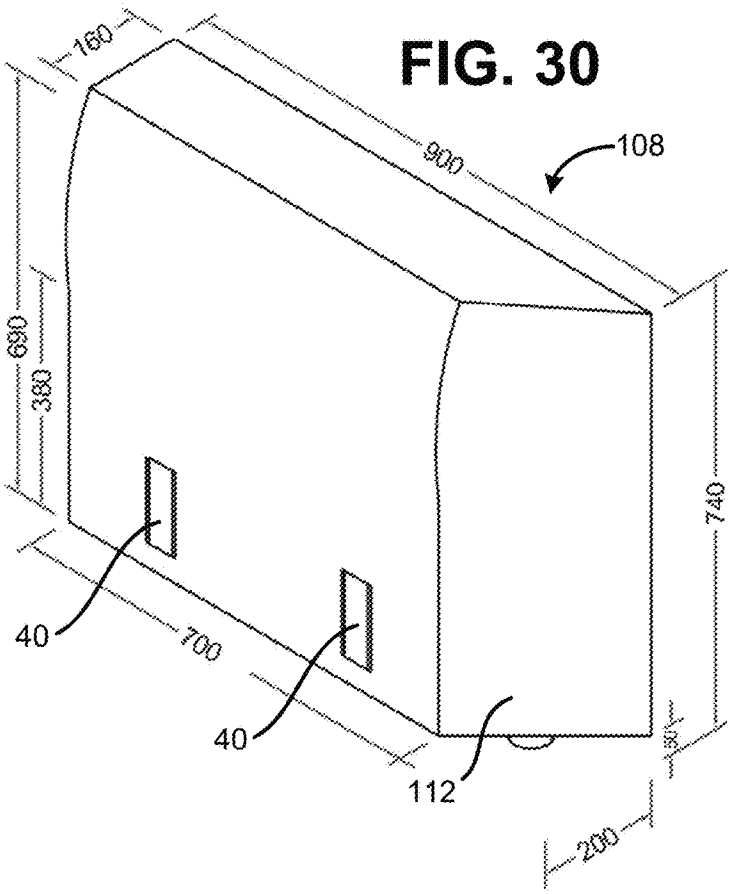
FIG. 30 is a perspective view of a first corner back unit.
Figure 32:
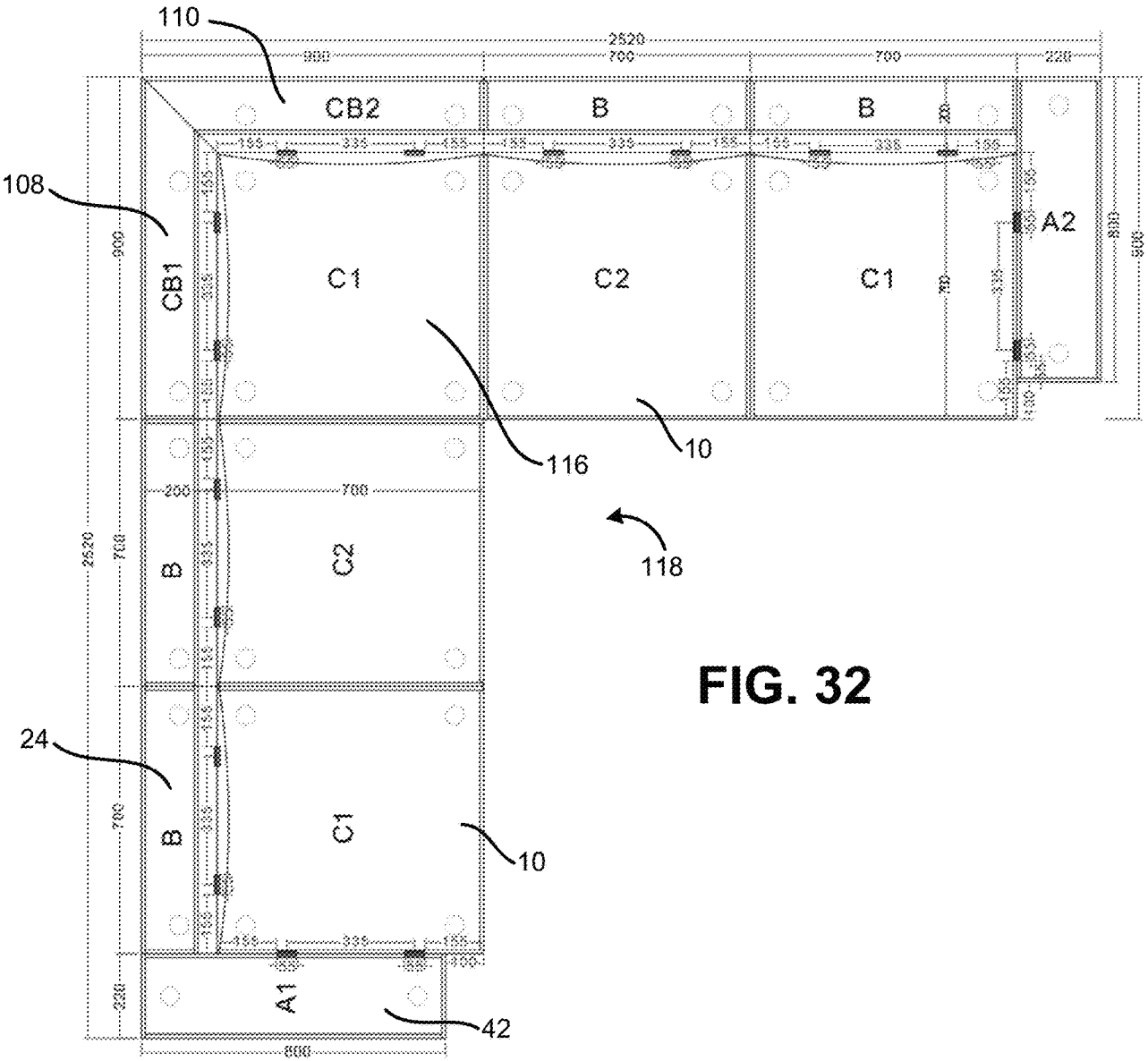
FIG. 32 is a top view of modular seating system incorporating the first corner back unit of FIG. 30 and the second corner back unit of FIG. 31.

Another embodiment of the back and/or arm, is in the form of a corner back unit 108, 110 having an angled side wall 112, 114 (i.e., at an angle other than 90 degrees) as shown in FIGS. 30 and 31. The angled side walls 112, 114 cooperate to form a corner seat 116 of a sectional system 118 like that shown in FIG. 32.

Many modifications and variations of the present invention are possible in light of the above teachings. It is, therefore, to be understood within the scope of the appended claims the invention may be protected otherwise than as specifically described.

I claim:

1. A modular seating system comprising:

a first seat having an upper surface, a first side wall extending downward from the upper surface, a second side wall extending down from the upper surface, a front wall extending downward from the upper surface and a back side wall extending downward from the upper surface, the back wall having a first set of first connector components;

a first back having a first set of second connector components, the back connected to the back wall of the first seat;

a plurality of legs extending downward from the first seat, wherein each leg of the plurality of legs has an outer perimeter; and, a first suction device connected to a lower surface of a first leg of the plurality of legs, the first suction device fitting within the outer perimeter of the first leg.

2. The modular seating system of claim 1 wherein the first suction device has a first lower channel.

3. The modular seating system of claim 2 wherein the first suction device has a second lower channel spaced from the first lower channel.

4. The modular seating system of claim 3 wherein the first suction device has a third lower channel spaced from the first lower channel and the second lower channel.

5. The modular seating system of claim 4 wherein the first suction device has a circular disk shape.

6. The modular seating system of claim 5 wherein each of the first lower channel, the second lower channel and the third lower channel is circular.

7. The modular seating system of claim 5 wherein the first suction device has a generally planar lower surface.

8. The modular seating system of claim 1 wherein the first suction device is formed from a rubber material.

9. The modular seating system of claim 1 wherein the first suction device is connected to the lower surface of the first leg by an adhesive material.

10. The modular seating system of claim 1 wherein a second leg of the plurality of legs includes a second suction device fitting within the outer perimeter of the second leg.

11. The modular seating system of claim 1 wherein the first side wall includes a first set of first connector components.

12. The modular seating system of claim 11 further comprising a first arm having a first set of second connector components for connecting the first arm to the first side wall of the first seat in a first position and a second set of second connector components for connecting the first arm to the first side wall of the first seat in a second position different than the first position.

13. The modular seating system of claim 1 wherein each of the first connector components is a rail secured to the first seat.

14. The modular seating system of claim 13 wherein each of the second connector components is a slider having a generally squared off C-shaped cross-sectional shape configured to slideably fit over a respective rail.

15. A modular seating system comprising:

a first seat having a rectangular upper surface, a first side wall, a second side wall, a front wall and a back wall, and a first leg having an outer perimeter extending downward from the first seat, a second leg having an outer perimeter extending downward from the first seat, a third leg having an outer perimeter extending downward from the first seat and a fourth leg having an outer perimeter extending downward from the first seat;

a first rail connector component on the first side wall of the first seat;

a second rail connector component on the back wall of the first seat;

a first suction device connected to a bottom surface of the first leg within the outer perimeter of the first leg, a second suction device connected to a bottom surface of the second leg within the outer perimeter of the second leg, a third suction device connected to a bottom surface of the third leg within the outer perimeter of the third leg and a fourth suction device connected to a bottom surface of the fourth leg within the outer perimeter of the fourth leg.

16. The modular seating system of claim 15 wherein each of the first, second, third and fourth suction devices include a first downward facing channel, a second downwardly facing channel spaced from the first downwardly facing channel and a third downwardly facing channel spaced from the second downwardly facing channel and the first downwardly facing channel.

17. The modular seating system of claim 16 wherein each of the first, second, third and fourth suction devices is circular, and each of the first downwardly facing channel, the second downwardly facing channel and the third downwardly facing channel are circular.

18. The modular seating system of claim 15 further comprising a first arm having a slider connector component slidably engaging the first rail connector component of the first seat, a first leg extending downward from the first arm and a second leg extending downward from the first arm.

19. The modular seating system of claim 18 further comprising a first back having a slider connector component slidably engaging the second rail component of the first seat, a first leg extending downward from the first back and a second leg extending downward from the first back.

20. A modular seating system comprising:

a plurality of seats, each seat having a first rail connector component and a plurality of legs wherein at least one of the plurality of legs includes an outer perimeter and a suction device connected to a bottom surface of the first leg within the outer perimeter;

an arm unit having a slider connector component coupled to the first rail component of one of the plurality of seats; and, a back unit having a slider connector component coupled to a first rail component of a second one of the plurality of seats.

* * * * *